US005497805A

United States Patent [19]

Sunamura et al.

[11] Patent Number: 5,497,805

[45] Date of Patent: Mar. 12, 1996

[54] DRIVE CONTROL SYSTEM FOR HYDRAULIC MACHINE

[75] Inventors: Kazuhiro Sunamura; Hidefumi Takegahara; Toichi Hirata, all of Ibaraki, Japan

[73] Assignee: Hitachi Construction Machinery Co., Ltd., Tokyo, Japan

[21] Appl. No.: 331,527

[22] PCT Filed: May 6, 1994

[86] PCT No.: PCT/JP94/00744

§ 371 Date: Oct. 31, 1994

§ 102(e) Date: Oct. 31, 1994

[87] PCT Pub. No.: WO94/27052

PCT Pub. Date: Nov. 24, 1994

[30] Foreign Application Priority Data

May 7, 1993 [JP] Japan ..... 5-106839

[51] Int. Cl.[6] ..... F15B 20/00

[52] U.S. Cl. ..... 137/596.16; 91/459; 91/461; 91/527; 91/529

[58] Field of Search ..... 91/459, 461, 527, 91/529; 137/596.16

[56] References Cited

FOREIGN PATENT DOCUMENTS 64-3305 1/1989 Japan .
64-3304 1/1989 Japan .
1-97729 4/1989 Japan .

*Primary Examiner*—Gerald A. Michalsky
*Attorney, Agent, or Firm*—Fay, Sharpe, Beall, Fagan, Minnich & McKee

[57] ABSTRACT

When an operator makes the reversing-lever operation by operating a control lever 4A in a direction $x_2$ in the event a solenoid proportional valve 91A of a directional control valve 8A is failed to be left open, an operation position sensor $\mathbf{30A_2}$ outputs a low-level signal and operation position sensors $\mathbf{30A_1}$, $\mathbf{30B_1}$, $\mathbf{30B_2}$ output high-level signals. Therefore, an AND circuit $\mathbf{6}b_2$ outputs a low-level signal and an AND circuit $\mathbf{6}b_1$ outputs a high-level signal, whereupon a switch signal is output from an amplifier **6*h* to a solenoid switching valve 121 for shifting it to a right-hand position shown in FIG. 1 so that a pilot line 51 is kept communicated with a reservoir 97. No switch signal is output from the amplifier 6*h* to a solenoid switching valve 122 for holding it in a left-hand position shown in FIG. 1 so that the pilot line 52 is kept communicated with a pilot pump 96. At this time, a drive signal from a metering calculating section 6*a* is input to a solenoid proportional valve 92A of the directional control valve 8A for excitation of the solenoid proportional valve 92A, and a secondary pilot pressure is applied from the solenoid proportional valve 92A to a pilot operated section 22A of the directional control valve 8A. Since a primary pilot pressure supplied to the solenoid proportional valve 91A is reduced down to a reservoir pressure through the solenoid switching valve 121, the directional control valve 8A held in the left-hand position shown in FIG. 1** can be easily shifted to the left for return to the neutral position.

7 Claims, 10 Drawing Sheets

DRIVE CONTROL SYSTEM FOR HYDRAULIC MACHINE

TECHNICAL FIELD

The present invention relates to a hydraulic machine such as a hydraulic excavator, and more particularly to a drive control system for hydraulic machines with which a hydraulic actuator is controlled in its driving by operating a control lever of an electric lever device.

BACKGROUND ART

Generally, a hydraulic machine such as a hydraulic excavator comprises a plurality of hydraulic actuators each of which is controlled by a drive control system including a control lever device. As disclosed in JP, A, 1-97729, for example, one of such drive control systems includes an electric lever device as the control lever device.

The disclosed drive control system is mounted on, e.g., hydraulic excavators for digging earth and sand or the like, and comprises an electric lever device which comprises a control lever operable in respective different operation areas disposed on both sides of a neutral position, a neutral position detecting device for detecting the neutral position of the control lever, and an output device, e.g., a potentiometer, for generating an electric operation signal depending on an input amount of the control lever; control means, i.e., a controller, which comprises calculating means for receiving the operation signal from the electric lever device and for calculating a control signal for a directional control valve corresponding to the received operation signal, and output means for outputting an electric drive signal corresponding to the control signal calculated by the calculating means; a pilot-operated directional control valve, which comprises a hydraulic converter for receiving the drive signal from the output means and converting it into a hydraulic signal, and is connected to a hydraulic circuit for driving a hydraulic actuator and is driven with a hydraulic pilot pressure from a hydraulic source; and a solenoid switching valve for receiving a detection signal from the neutral position detecting device equipped in the electric lever device to selectively cut off the hydraulic pilot pressure between the hydraulic source and the electro-hydraulic converter when the control lever is in the neutral position.

The directional control valve, the electric lever device, and the output means of the controller are each provided plural in number corresponding to a plurality of hydraulic actuators, e.g., a boom cylinder, an arm cylinder, a bucket cylinder, a swing motor and a travel motor.

With the arrangement described above, the disclosed prior art is primarily intended to ensure safety of work by returning the control lever to the neutral position, even if there occurs a failure, mixing noise or any other trouble in the control equipment, signal lines and so on which are located between the electric lever device and the controller.

More specifically, when the control lever of the electric lever device is operated a predetermined amount from the neutral position in the above drive control system, an operation signal depending on such an input amount of the control lever is output from the potentiometer and applied to the controller. The calculating means in the controller calculates a control signal corresponding to the operation signal, and a drive signal corresponding to the control signal is output from the output means in the controller, followed by being applied to the electro-hydraulic converter for conversion into a hydraulic signal. In this case, since the solenoid switching valve does not cut off the hydraulic pilot pressure, the hydraulic pilot pressure from the hydraulic source is supplied through the electro-hydraulic converter to one of the hydraulic pilot operated sections of the directional control valve on both of its sides, whereupon the directional control valve is shifted. Correspondingly, a hydraulic fluid delivered from a hydraulic pump is supplied to the hydraulic actuator so that the hydraulic actuator is driven to operate an associated working member, e.g., one of a boom, an arm, a bucket, an upper swing, and a lower travel device.

On the other hand, when the control lever of the electric lever device is in the neutral position, this condition is detected by the neutral position detecting device and the corresponding detection signal is input to the solenoid switching valve which then cuts off the hydraulic pilot pressure between the hydraulic source and the electro-hydraulic converter. Accordingly, even if an error signal is produced in the controller, etc. due to a failure or due to mixing noise, causing the electro-hydraulic converter to malfunction, the directional control valve is supplied with no hydraulic pilot pressure and is held in its neutral position. Therefore, the hydraulic actuator is kept stopped. It is thus possible to prevent movement of the hydraulic actuator not intended by an operator and to ensure safety.

DISCLOSURE OF THE INVENTION

The above-described prior art, however, has the following inconvenience.

Generally, hydraulic machines such as hydraulic excavators are required to include some measure for coping with the occurrence of a failure from the standpoint of ensuring safety. In other words, without regard to improvements in the reliability of component members of the hydraulic machine themselves, it is desired that the machine is constructed so as to avoid a possible danger and ensure safety of the operator, buildings, etc. even if any failure or malfunction should be caused in the component members of the hydraulic machine.

Supposing now, for example, that the hydraulic converter associated with the directional control valve fails, i.e., that one of the hydraulic converters equipped on both sides of the directional control valve fails and remains open while the operator is operating the control lever in one of the operation areas. The pilot pressure introduced from the hydraulic source continues to be supplied to one hydraulic pilot operated section of the directional control valve, thereby keeping the directional control valve being driven open in one direction regardless of the input amount of the control lever. This results in the operator no longer being able to control the speed of the hydraulic actuator. In this case, because the actuator is not stopped and continues to operate in one direction even with the control lever returned to some extent in that one operation area, the operator usually tends to, by a reflex action, return the control lever into the opposite operation area beyond the neutral position (hereinafter this operation will be also referred to as a reversing-lever operation), aiming to avoid any danger.

In the above-described prior art, if the control lever is returned to the neutral position, the solenoid switching valve is activated to cut off the hydraulic pilot pressure. However, when the operator makes the reversing-lever operation beyond the neutral position as mentioned above, the solenoid switching valve is not activated to cut off the hydraulic pilot pressure and hence the hydraulic pilot pressure still continues to be supplied to one hydraulic pilot operated section of the directional control valve.

Thus, even with the pilot pressure applied to the other hydraulic pilot operated section of the directional control valve by the reversing-lever operation, the pilot pressure is resultingly supplied to both the hydraulic pilot operated sections of the directional control valve, meaning that it is difficult to shift the directional control valve in a direction opposite to the original shift direction and returned to the neutral position. This leads to a inconvenience of difficulties in stopping the operation of the hydraulic actuator.

The present invention has been accomplished in view of the above-described situation in the prior art, and its object is to provide a drive control system for hydraulic machines with which a directional control valve can be surely returned to its neutral position to stop operation of an actuator, even when an operator makes the reversing-lever operation upon a failure of one of hydraulic converters associated with the directional control valve.

To achieve the above object, according to the present invention, there is provided a drive control system for hydraulic machines comprising an electric lever device which includes a control lever operable in each of first and second operation areas with its neutral position therebetween and output means for generating an electric signal depending on an input amount of said control lever, first calculating means for calculating a drive signal corresponding to said electric signal, a pilot circuit including a hydraulic source for generating a primary pilot pressure, and a pilot-operated directional control valve provided respectively at opposite ends with electro-hydraulic conversion means each of which receives the drive signal from said first calculating means and the primary pilot pressure from said pilot circuit and outputs a secondary pilot pressure corresponding to said drive signal, and with pilot operated sections to which the secondary pilot pressures are applied from said electro-hydraulic conversion means, said directional control valve being driven with the secondary pilot pressures applied to said pilot operated sections for controlling a hydraulic fluid supplied to a hydraulic actuator, wherein said drive control system comprises operation position detecting means for detecting in which one of said first and second operation areas said control lever is operated, and pilot pressure control means disposed in said pilot circuit for reducing the primary pilot pressure applied to said electro-hydraulic conversion means on the side corresponding to said first operation area when said operation position detecting means does not detect that said control lever is operated into said first operation area, holding the primary pilot pressure applied to said electro-hydraulic conversion means on the side corresponding to said first operation area when said operation position detecting means detects that said control lever is operated into said first operation area, reducing the primary pilot pressure applied to said electro-hydraulic conversion means on the side corresponding to said second operation area when said operation position detecting means does not detect that said control lever is operated into said second operation area, and holding the primary pilot pressure applied to said electro-hydraulic conversion means on the side corresponding to said second operation area when said operation position detecting means detects that said control lever is operated into said second operation area.

With the present invention thus arranged, for example, when an operator operates the control lever of the electric lever device by a predetermined amount from the neutral position into the first operation area with the intention of operating the actuator in one direction, an electric signal corresponding to the input amount by which the control lever is operated is generated from the output means of the electric lever device, and the first calculating means calculates a drive signal corresponding to the electric signal, the drive signal being input to the electro-hydraulic conversion means on the side corresponding to the first operation area. At this time, since the operation position detecting means detects that the control lever is operated into the first operation area, the pilot pressure control means holds the primary pilot pressure that is generated by the hydraulic source in the pilot circuit and applied to the electro-hydraulic conversion means on the side corresponding to the first operation area, allowing the primary pilot pressure to be applied to that electro-hydraulic conversion means. Then, this electro-hydraulic conversion means applies a secondary pilot pressure depending on the drive signal and the primary pilot pressure, both of which have been applied thereto, to the corresponding pilot operated section. Also at this time, since the operation position detecting means does not detect that the control lever is operated into the second operation area, the pilot pressure control means reduces the primary pilot pressure that is generated by the hydraulic source in the pilot circuit and applied to the side corresponding to the second operation area. Accordingly, the directional control valve is shifted in a direction corresponding to the first operation area, whereupon the hydraulic fluid is supplied to the actuator for operating it in one direction.

When the operator operates the control lever of the electric lever device by a predetermined amount from the neutral position into the second operation area with the intention of operating the actuator in the other direction, the drive signal is input from the first calculating means to the electro-hydraulic conversion means on the side corresponding to the second operation area, the predetermined primary pilot pressure is applied to that electro-hydraulic conversion means, and the secondary pilot pressure depending on both the drive signal and the primary pilot pressure is applied to the corresponding pilot operated section. On the other hand, the primary pilot pressure on the side corresponding to the first operation area is reduced. As a result, the directional control valve is shifted in a direction corresponding to the second operation area, whereupon the hydraulic fluid is supplied to the actuator for operating it in the other direction.

If the electro-hydraulic conversion means on the side corresponding to the first operation area is failed to be left open in any of the above operating conditions, the secondary pilot pressure from that electro-hydraulic conversion means would continue to be supplied to the pilot operated section, and hence the directional control valve could no longer control the speed, keeping the actuator operating in one direction.

Then, when the operator makes the reversing-lever operation by operating the control lever into the second operation area with the intent to avoid danger, the operation position detecting means detects that the control lever is operated into the second operation area, and the pilot pressure control means holds the primary pilot pressure that is applied to the electro-hydraulic conversion means on the side corresponding to the second operation area. As with the above case, therefore, the secondary pilot pressure depending on that primary pilot pressure and the drive signal from the first calculating means is applied to the pilot operated section from the electro-hydraulic conversion means on the side corresponding to the second operation area. At this time, since the operation position detecting means does not detect that the control lever is operated into the first operation area, the pilot pressure control means reduces the primary pilot pressure that is applied to the electro-hydraulic conversion means on the side corresponding to the first operation area. Accordingly, the secondary pilot pressure applied from that electro-hydraulic conversion means to the pilot operated section is also reduced.

As a result, since the predetermined secondary pilot pressure is applied to the pilot operated section on the side corresponding to the second operation area and the secondary pilot pressure applied to the pilot operated section on the side corresponding to the first operation area is reduced, the operator can shift the directional control valve in a direction corresponding to the second operation area, i.e., in a direction opposite to the original direction, for surely returning it to the neutral position, and can stop the actuator from operating it in that one direction.

Further, when the operator makes the reversing-lever operation into the first operation area in the event the electro-hydraulic conversion means on the side corresponding to the second operation area is failed to be left open, the predetermined secondary pilot pressure is applied to the pilot operated section on the side corresponding to the first operation area and the secondary pilot pressure applied to the pilot operated section on the side corresponding to the second operation area is reduced, as with the above case. Therefore, the operator can shift the directional control valve in a direction corresponding to the first operation area for surely returning to the neutral position, and can stop the actuator from operating in the other direction.

In the above drive control system for hydraulic machines, preferably, said pilot circuit comprises a first pilot line for connecting said hydraulic source to said electro-hydraulic conversion means on the side corresponding to said first operation area, and a second pilot line being independent of said first pilot circuit and connecting said hydraulic source to said electro-hydraulic conversion means on the side corresponding to said second operation area, and said pilot pressure control means comprises a first solenoid switching valve disposed in said first pilot line for communicating said first pilot line with a reservoir when said operation position detecting means does not detect that said control lever is operated into said first operation area, and cutting off communication between said first pilot line and said reservoir when said operation position detecting means detects that said control lever is operated into said first operation area, and a second solenoid switching valve disposed in said second pilot line for communicating said second pilot line with said reservoir when said operation position detecting means does not detect that said control lever is operated into said second operation area, and cutting off communication between said second pilot line and said reservoir when said operation position detecting means detects that said control lever is operated into said second operation area.

With such an arrangement, for example, when the operator makes the reversing-lever operation into the second operation area in the event the electro-hydraulic conversion means on the side corresponding to the first operation area is failed while the control lever is being operated in the first operation area, the first pilot line is communicated with the reservoir through the first solenoid proportional valve. Therefore, the primary pilot pressure applied to the failed electro-hydraulic conversion means on the side corresponding to the first operation area can be reduced to the reservoir pressure, and the secondary pilot pressure applied to the corresponding pilot operated section can also be reduced to the reservoir pressure. At the same time, since the communication between the second pilot line and the reservoir is cut off by the second solenoid proportional valve, the predetermined primary pilot pressure can be applied to the electro-hydraulic conversion means on the side corresponding to the second operation area, and the corresponding secondary pilot pressure can be applied to the corresponding pilot operated section.

When the operator makes the reversing-lever operation into the first operation area while the control lever is being operated in the second operation area, the second pilot line is communicated with the reservoir through the second solenoid proportional valve. Therefore, the primary pilot pressure applied to the failed electro-hydraulic conversion means on the side corresponding to the second operation area can be reduced to the reservoir pressure, and the secondary pilot pressure applied to the corresponding pilot operated section can also be reduced to the reservoir pressure. At the same time, since the communication between the first pilot line and the reservoir is cut off by the first solenoid proportional valve, the predetermined primary pilot pressure can be applied to the electro-hydraulic conversion means on the side corresponding to the first operation area, and the corresponding secondary pilot pressure can be applied to the corresponding pilot operated section.

In the above drive control system for hydraulic machines, preferably, said operation position detecting means comprises first sensor means disposed in said electric lever device for outputting a first non-operation signal when said control lever is not operated into said first operation area, and a first operation signal when said control lever is operated into said first operation area, and second sensor means disposed in said electric lever device for outputting a second non-operation signal when said control lever is not operated into said second operation area, and a second operation signal when said control lever is operated into said second operation area.

With such an arrangement, for example, when the operator makes the reversing-lever operation into the second operation area in the event the electro-hydraulic conversion means on the side corresponding to the first operation area is failed while the control lever is being operated in the first operation area, the first sensor means provided in the electric lever device outputs the first non-operation signal, and the second sensor means outputs the second operation signal. From these signals, it can be detected that the control lever is operated into the second operation area. When the operator makes the reversing-lever operation into the first operation area in the event the electro-hydraulic conversion means on the side corresponding to the second operation area is failed while the control lever is being operated in the second operation area, the first sensor means provided in the electric lever device outputs the first operation signal, and the second sensor means outputs the second non-operation signal. From these signals, it can be detected that the control lever is operated into the first operation area.

In the above drive control system for hydraulic machines, preferably, said operation position detecting means includes second calculating means for creating, based on the magnitude of the electric signal from said electric lever device, a first non-operation signal when said control lever is not operated into said first operation area and a first operation signal when said control lever is operated into said first operation area, and a second non-operation signal when said control lever is not operated into said second operation area and a second operation signal when said control lever is operated into said second operation area.

With such an arrangement, for example, when the operator makes the reversing-lever operation into the second operation area in the event the electro-hydraulic conversion means on the side corresponding to the first operation area is failed while the control lever is being operated in the first operation area, the second calculating means creates the first non-operation signal and the second operation signal. From these signals, it can be detected that the control lever is operated into the second operation area. When the operator makes the reversing-lever operation into the first operation area in the event the electro-hydraulic conversion means on the side corresponding to the second operation area is failed while the control lever is being operated in the second operation area, the second calculating means creates the first operation signal and the second non-operation signal. From these signals, it can be detected that the control lever is operated into the first operation area.

In the above drive control system for hydraulic machines, preferably, said electric lever device, said actuator, said directional control valve, and said operation position detecting means are each provided plural in number, and said pilot pressure control means reduces the primary pilot pressure applied to said electro-hydraulic conversion means on the side corresponding to said first operation areas when all of said plurality of operation position detecting means do not detect that said control levers are operated into said first operation areas, holds the primary pilot pressure applied to said electro-hydraulic conversion means on the side corresponding to said first operation areas when at least one of said plurality of operation position detecting means detect that any of said control levers are operated into said first operation areas, reduces the primary pilot pressure applied to said electro-hydraulic conversion means on the side corresponding to said second operation areas when all of said plurality of operation position detecting means do not detect that said control levers are operated into said second operation areas, and holds the primary pilot pressure applied to said electro-hydraulic conversion means on the sides corresponding to said second operation areas when at least one of said plurality of operation position detecting means detects that any of said control levers are operated into said second operation areas.

With such an arrangement, even in a hydraulic machine in which the hydraulic fluid is supplied to the plurality of actuators through the plurality of directional control valves operated by the plurality of control levers, when the operator makes the reversing-lever operation in the event the electro-hydraulic conversion means on one side of any of the directional control valves is failed, the pilot pressure control means reduces the primary and secondary pilot pressures applied to the electro-hydraulic conversion means and the pilot operated section on the failed side, and applies the predetermined primary and secondary pilot pressures to the electro-hydraulic conversion means and the pilot operated section on the other side. Therefore, the operator can shift that directional control valve in a direction opposite to the original direction for surely returning to the neutral position, and can stop the operation of the actuator.

In the above drive control system for hydraulic machines, preferably, said pilot circuit comprises a first pilot line for connecting said electro-hydraulic conversion means on the side corresponding to said first operation areas of said plurality of directional control valves to said hydraulic source, and a second pilot line being independent of said first pilot circuit and connecting said electro-hydraulic conversion means on the side corresponding to said second operation areas of said plurality of directional control valves to said hydraulic source, and said pilot pressure control means comprises a first solenoid switching valve disposed in said first pilot line for communicating said first pilot line with a reservoir when all of said plurality of operation position detecting means do not detect that said control levers are operated into said first operation areas, and cutting off communication between said first pilot line and said reservoir when at least one of said plurality of operation position detecting means detects that any of said control levers is operated into said first operation area, and a second solenoid switching valve disposed in said second pilot line for communicating said second pilot line with said reservoir when all of said plurality of operation position detecting means do not detect that said control levers are operated into said second operation areas, and cutting off communication between said second pilot line and said reservoir when at least one of said operation position detecting means detects that any of said control lever is operated into said second operation area.

With such an arrangement, in a hydraulic machine in which the hydraulic fluid is supplied to the plurality of actuators through the plurality of directional control valves operated by the plurality of control levers, when the operator makes the reversing-lever operation into the second operation area in the event the electro-hydraulic conversion means on one side of any of the directional control valves is failed, the first pilot line is communicated with the reservoir through the first solenoid switching valve, whereby the primary and secondary pilot pressures applied to the electro-hydraulic conversion means and the pilot operated section corresponding to the first pilot line can be reduced down to the reservoir pressure. Also, the communication between the second pilot line and the reservoir is cut off by the second solenoid switching valve, whereby the predetermined primary and secondary pilot pressures can be applied to the electro-hydraulic conversion means and the pilot operated section corresponding to the second pilot line.

When the operator makes the reversing-lever operation into the first operation area, the second pilot line is communicated with the reservoir through the second solenoid switching valve, whereby the primary and secondary pilot pressures applied to the electro-hydraulic conversion means and the pilot operated section corresponding to the second pilot line can be reduced down to the reservoir pressure. Also, the communication between the first pilot line and the reservoir is cut off by the first solenoid switching valve, whereby the predetermined primary and secondary pilot pressures can be applied to the electro-hydraulic conversion means and the pilot operated section corresponding to the first pilot line.

In the above drive control system for hydraulic machines, preferably, said electro-hydraulic conversion means include solenoid proportional valves of which openings are controlled in accordance with the drive signals from said first calculating means. With such an arrangement, the primary pilot pressure generated by the hydraulic source and supplied through the pilot circuit can be applied to the pilot operated section as the secondary pilot pressure depending on the input amount of the control lever provided in the electric lever device.

BEST MODE FOR CARRYING OUT THE INVENTION

Hereinafter, embodiments of a drive control system for hydraulic machines according to the present invention will be described with reference to the drawings.

First Embodiment

A first embodiment of the present invention will be described with reference to FIGS. 1 to 6.

Figure 1:
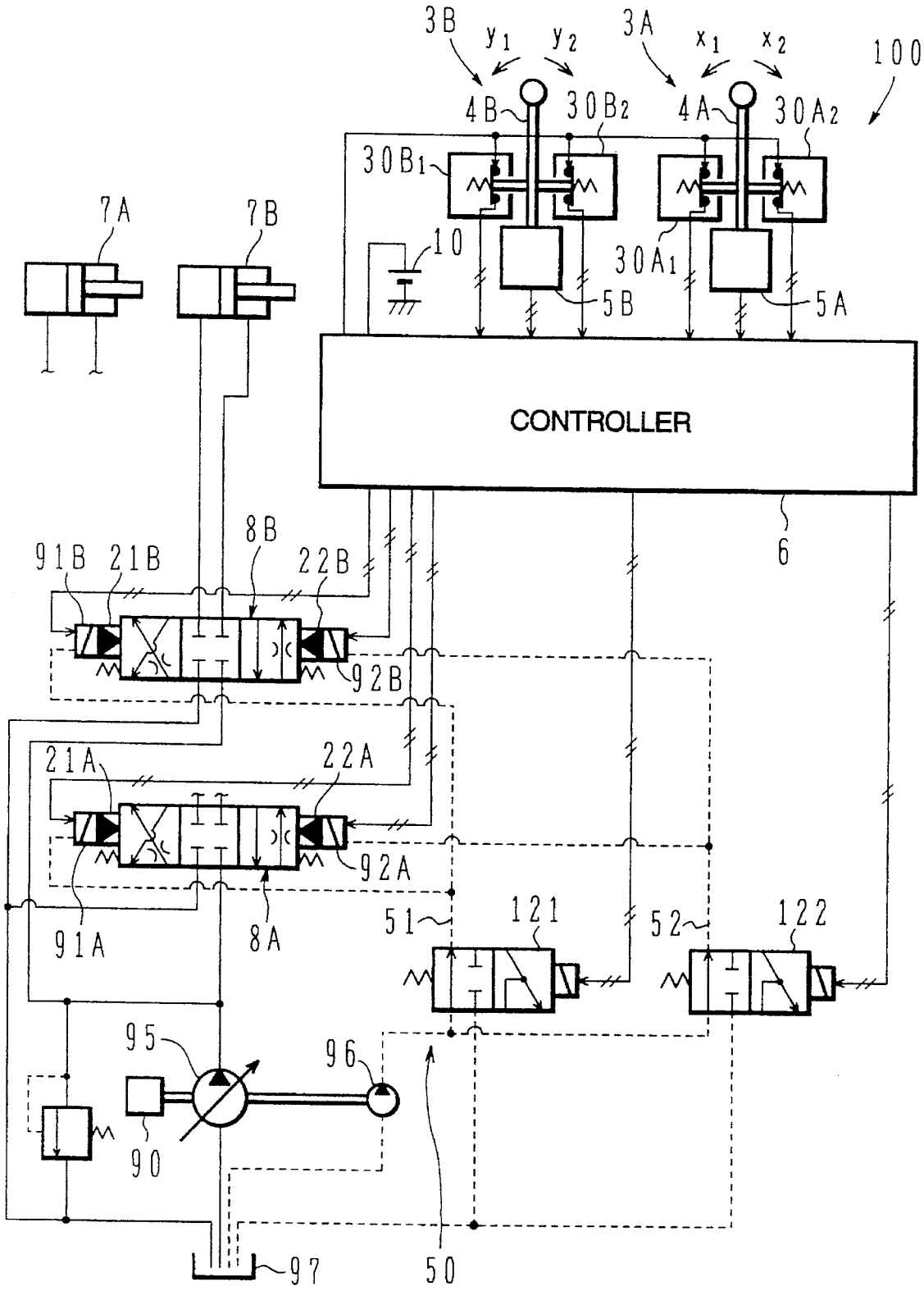
FIG. 1 is a circuit diagram showing a drive control system for hydraulic machines according to a first embodiment of the present invention.

A circuit diagram showing a drive control system for hydraulic machines of this embodiment is illustrated in FIG. 1. Referring to FIG. 1, a drive control system 100 of this embodiment comprises electric lever devices 3A, 3B which comprise respectively a control lever 4A operable in any of a direction $x_1$ and a direction $x_2$ with its neutral position therebetween, a control lever 4B operable in any of a direction $y_1$ and a direction $y_2$ with its neutral position therebetween, output means, e.g., potentiometers 5A, 5B, for generating respective electric signals depending on input amounts of the control levers 4A, 4B, and operation position sensors 30$A_1$, 30$A_2$, 30$B_1$, 30$B_2$ for detecting in which ones of the $x_1$ and $x_2$ directions and the $y_1$ and $y_2$ directions the control levers 4A, 4B are operated, a pilot circuit 50 including a hydraulic source, e.g., a pilot pump 96, for generating a primary pilot pressure, pilot-operated directional control valves 8A, 8B for controlling respective flows of a hydraulic fluid supplied from a hydraulic pump 95, which is driven by a prime mover 90, to actuators in two systems, e.g., a boom cylinder 7A and an arm cylinder 7B of a hydraulic excavator, a controller 6 for controlling operation of the directional control valves 8A, 8B in accordance with electric signals from the potentiometers 5A, 5B, and a main power supply 10 connected to the controller 6.

The operation position sensors 30$A_1$, 30$A_2$, 30$B_1$, 30$B_2$ provided in the electric lever devices 3A, 3B are supplied with a voltage from the main power supply 10 through the controller 6. The operation position sensor 30$A_1$ outputs a non-operation signal, e.g., a high-level signal, when the control lever 4A is not operated in the direction $x_1$, i.e., when it is operated in the direction $x_2$ or in the neutral position, and outputs an operation signal, e.g., a low-level signal, when the control lever 4A is operated in the $x_1$ direction. Also, the operation position sensor 30$A_2$ outputs a non-operation signal, e.g., a high-level signal, when the control lever 4A is not operated in the direction $x_2$, i.e., when it is operated in the direction $x_1$ or in the neutral position, and outputs an operation signal, e.g., a low-level signal, when the control lever 4A is operated in the direction $x_2$.

The operation position sensor 30$B_1$ provided in the electric lever device 3B outputs a non-operation signal, e.g., a high-level signal, when the control lever 4B is not operated in the direction $y_1$, i.e., when it is operated in the direction $y_2$ or in the neutral position, and outputs an operation signal, e.g., a low-level signal, when the control lever 4B is operated in the direction $y_1$. Also, the operation position sensor 30$B_2$ outputs a non-operation signal, e.g., a high-level signal, when the control lever 4B is not operated in the direction $y_2$, i.e., when it is operated in the direction $y_1$ or in the neutral position, and outputs an operation signal, e.g., a low-level signal, when the control lever 4B is operated in the direction $y_2$ .

The directional control valves 8A, 8B include respectively, at opposite ends thereof, electro-hydraulic conversion means, e.g., solenoid proportional valves 91A, 92A; 91B, 92B, for receiving drive signals from the controller 6 and the primary pilot pressure from the pilot circuit 50 and outputting secondary pilot pressures corresponding to the drive signals, and pilot operated sections 21A, 22A; 21B, 22B supplied with the respective secondary pilot pressures output from the solenoid proportional valves 91A, 92A; 91B, 92B. The directional control valves 8A, 8B are driven with the secondary pilot pressures applied to the pilot operated sections 21A, 22A; 21B, 22B.

The pilot circuit 50 comprises a pilot line 51 for connecting the pilot pump 96 to the solenoid proportional valves 91A, 91B on the sides corresponding to the $x_1$, $y_1$ directions of the control levers 4A, 4B, and a pilot line 52, which is independent of the pilot line 51, for connecting the pilot pump 96 to the solenoid proportional valves 92A, 92B on the sides corresponding to the $x_2$, $y_2$ directions of the control levers 4A, 4B. Further, the pilot line 51 includes a solenoid switching valve 121 receiving a signal from the controller 6 and being able to selectively communicate and cut off the pilot line 51 with and from a reservoir 97, whereas the pilot line 52 includes a solenoid switching valve 122 being able to selectively communicate and cut off the pilot line 52 with and from the reservoir 97. The solenoid switching valves 121, 122 are normally held in their left-hand shift positions shown in FIG. 1 by the forces of respective springs so that the pilot lines 51, 52 are cut off from the reservoir 97, but are communicated with the pilot pump 96, enabling the primary pilot pressure from the pilot pump 96 to be supplied to the pilot lines 51, 52. Also, when the solenoid switching valves 121, 122 are excited upon receiving switch signals (described later) from the controller 6, these valves 121, 122 are shifted against the forces of the springs to their right-hand shift positions shown in FIG. 1 so that the pilot lines 51, 52 are communicated with the reservoir 97 to reduce the pilot pressures in the pilot pumps 51, 52 down to a reservoir pressure.

Figure 2:
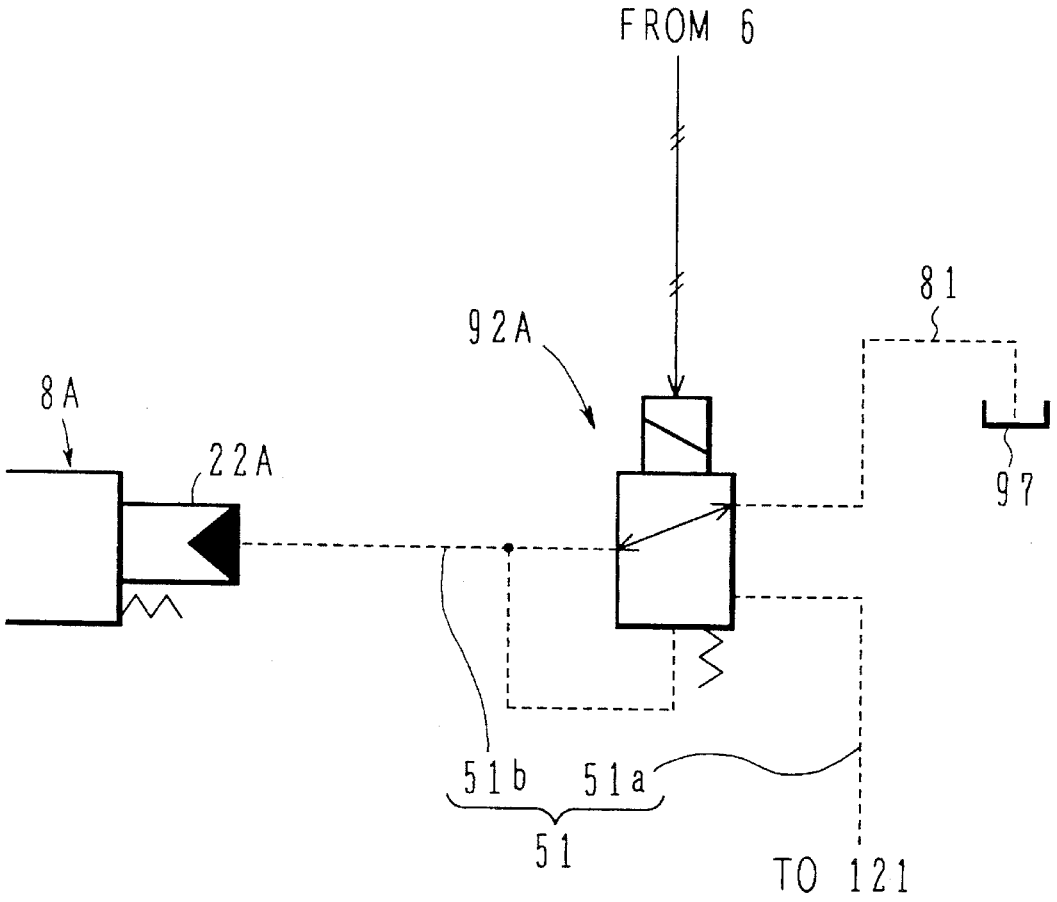
FIG. 2 is a circuit diagram showing a detailed structure of a solenoid proportional valve shown in FIG. 1.

A detailed structure of the solenoid proportional valve 92A is shown in FIG. 2. Referring to FIG. 2, the solenoid proportional valve 92A is arranged to normally communicate a secondary pilot line 51*b*, as a part of the pilot line 51, with a reservoir line 81 connected to the reservoir 97, as shown, by the force of a spring. When the solenoid proportional valve 92A is excited upon receiving the drive signal from the controller 6, it is shifted against the force of the spring to communicate the secondary pilot line 51*b* with a primary pilot line 51*a* for introducing the primary pilot pressure through the solenoid switching valve 121 in an opening corresponding to the magnitude of the applied drive signal. The solenoid proportional valves 92B, 91A, 91B are each of the same structure.

Figure 3:
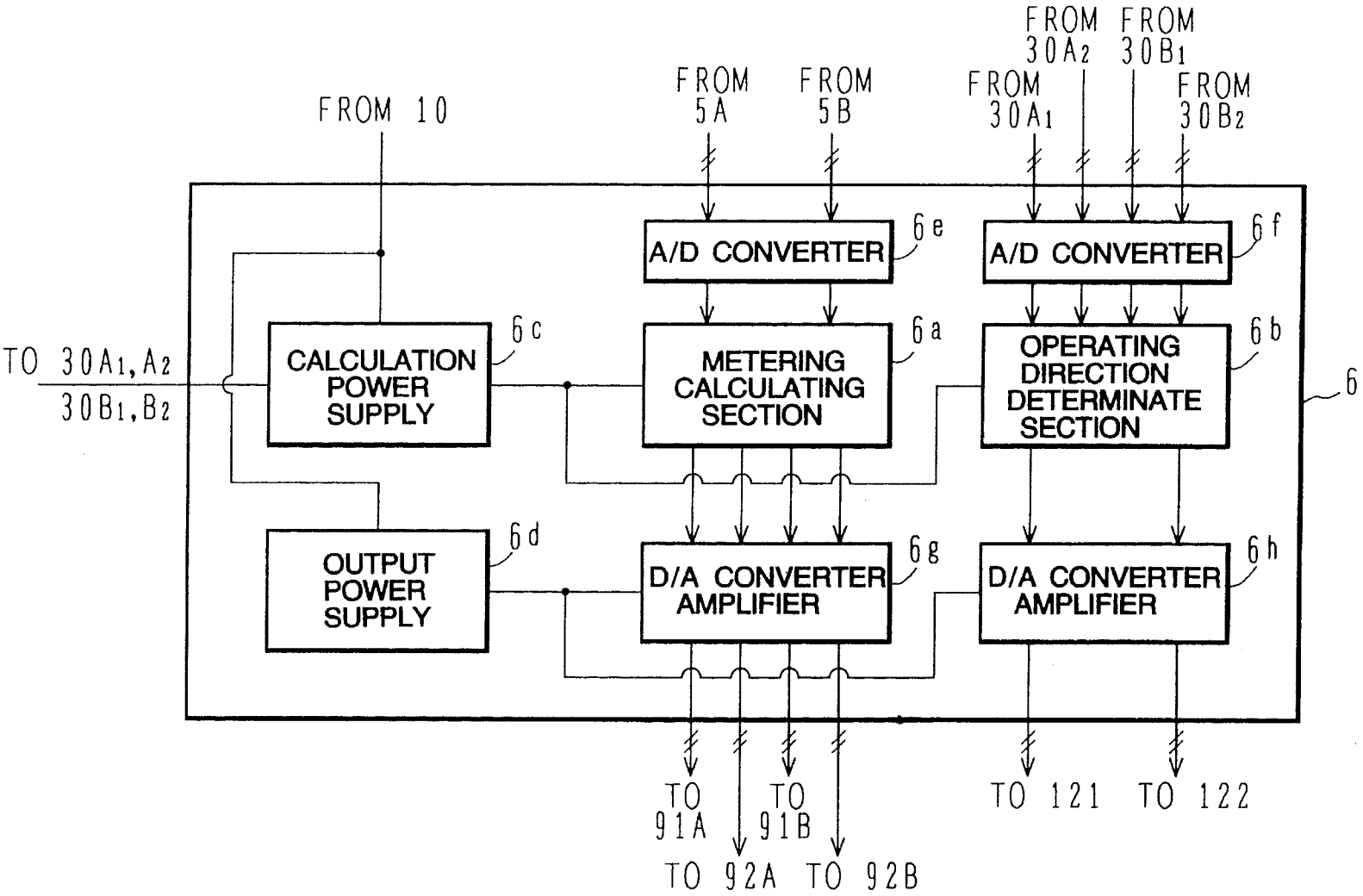
FIG. 3 is a block diagram showing details of functions of a controller shown in FIG. 1.

Details of functions of the controller 6 are shown in FIG. 3. Referring to FIG. 3, the controller 6 comprises an A/D converter 6*e* for receiving the electric signals from the potentiometers 5A, 5B and converting the received signals into digital signals, calculating means, e.g., a metering calculating section 6*a*, for calculating drive signals corresponding to the converted signals, a D/A converter-amplifier 6*g* for converting the drive signals into analog signals, amplifying the analog signals and outputting them to the solenoid proportional valves 91A, 92A, 91B, 92B, an A/D converter 6*f* for receiving the operation signals or the non-operation signals from the operation position sensors $\mathbf{30A_1}$, $\mathbf{30A_2}$, $\mathbf{30B_1}$, $\mathbf{30B_2}$ and converting the received signals into digital signals, an operating direction determinate section 6*b* for determining the directions in which the control levers 4A, 4B are operated, based on the converted signals and outputting corresponding switch signals to shift the solenoid switching valves 121, 122, a D/A converter-amplifier 6*h* for converting the switch signals into analog signals, amplifying the analog signals and outputting them to the solenoid switching valves 121, 122, a calculation power supply 6*c* connected to the main power supply 10 for supplying electric power to the metering calculating section 6*a*, the operating direction determinate section 6*b* and the operation position sensors $\mathbf{30A_1}$, $\mathbf{30A_2}$, $\mathbf{30B_1}$, $\mathbf{30B_2}$, and an output power supply 6*d* connected to the main power supply 10 for supplying electric power to the D/A converters-amplifiers 6*g*, 6*h*.

Figure 4:
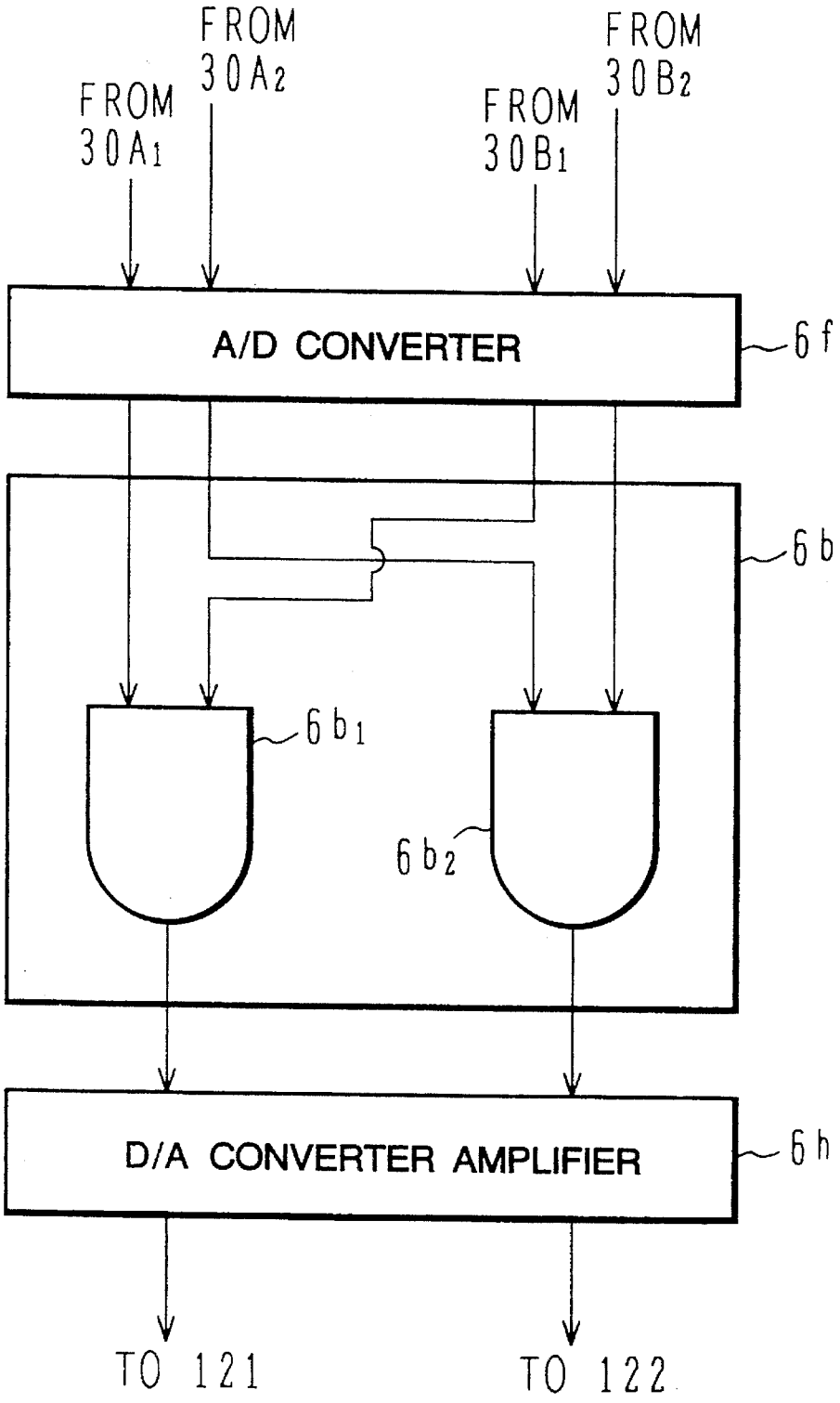
FIG. 4 is a block diagram showing details of functions of an operating direction determinate section shown in FIG. 3.

Details of functions of the operating direction determinate section 6*b* are shown in FIG. 4. Referring to FIG. 4, the operating direction determinate section 6*b* comprises two AND circuits $\mathbf{6}b_1$, $\mathbf{6}b_2$. The operation or non-operation signals from the operation position sensors $\mathbf{30A_1}$, $\mathbf{30B_1}$ are subject to digital conversion in the A/D converter 6*f* and then applied to the AND circuit $\mathbf{6}b_1$. After logical operation, the switch signal for shifting the solenoid switching valve 121 is output from the AND circuit $\mathbf{6}b_1$ to the D/A converter-amplifier 6*h*. Also, the operation or non-operation signals from the operation position sensors $\mathbf{30A_2}$, $\mathbf{30B_2}$ are subject to digital conversion in the A/D converter 6*f* and then applied to the AND circuit $\mathbf{6}b_2$. After logical operation, the switch signal for shifting the solenoid switching valve 122 is output from the AND circuit $\mathbf{6}b_2$ to the D/A converter-amplifier 6*h*.

In the above arrangement, the direction $x_1$ and the direction $y_1$ in which the control levers 4A, 4B are operated make up first operating area, and the direction $x_2$ and the direction $y_2$ in which the control levers 4A, 4B are operated make up the second operating area. The operation position sensors $\mathbf{30A_1}$, $\mathbf{30A_2}$, $\mathbf{30B_1}$, $\mathbf{30B_2}$ make up operation position detecting means for detecting in which ones of the directions $x_1$, $y_1$ and the directions $x_2$, $y_2$ the control levers 4A, 4B are operated. Further, the solenoid switching valves 121, 122, the pilot lines 51, 52, and the operating direction determinate section 6*b* in the controller 6 cooperatively make up pilot pressure control means for reducing the primary pilot pressure applied to the solenoid proportional valves 91A, 91B on the corresponding sides when the operation position sensors $\mathbf{30A_1}$, $\mathbf{30B_1}$ do not detect that the control levers 4A, 4B are operated respectively in the $x_1$, $y_1$ directions, holding the primary pilot pressure applied to the solenoid proportional valves 91A, 91B on the corresponding sides when the operation position sensors $\mathbf{30A_1}$, $\mathbf{30B_1}$ detect that the control levers 4A, 4B are operated respectively in the $x_1$, $y_1$ directions, reducing the primary pilot pressure applied to the solenoid proportional valves 92A, 92B on the corresponding sides when the operation position sensors $\mathbf{30A_2}$, $\mathbf{30B_2}$ do not detect that the control levers 4A, 4B are operated respectively in the $x_2$, $y_2$ directions, holding the primary pilot pressure applied to the solenoid proportional valves 92A, 92B on the corresponding sides when the operation position sensors $\mathbf{30A_2}$, $\mathbf{30B_2}$ detect that the control levers 4A, 4B are operated respectively in the $x_2$, $y_2$ directions.

This embodiment arranged as described above operates as follows.

For example, when the control lever 4A of the electric lever device 3A is operated in the direction $x_1$ from the neutral position by an operator while the control lever 4B of the electric lever device 3B is in the neutral position, the operation position sensor $\mathbf{30A_1}$ outputs a low-level signal and the operation position sensors $\mathbf{30A_2}$, $\mathbf{30B_1}$, $\mathbf{30B_2}$ output high-level signals, all of these signals being input through the A/D converter 6*f* to the operating direction determinate section 6*b* in the controller 6. Specifically, the low-level signal from the operation position sensor $\mathbf{30A_1}$ and the high-level signal from the operation position sensor $\mathbf{30B_1}$ are input to the AND circuit $\mathbf{6}b_1$ of the operating direction determinate section 6*b*, causing the AND circuit $\mathbf{6}b_1$ to output a low-level signal. Both the high-level signals from the operation position sensors $\mathbf{30A_2}$, $\mathbf{30B_2}$ are input to the AND circuit $\mathbf{6}b_2$ which outputs a high-level signal. Accordingly, the switch signal is not output from the amplifier 6*h* to the solenoid switching valve 121 so that the solenoid switching valve 121 is not shifted and remains held in the left-hand position shown in FIG. 1, but the switch signal is output to the solenoid switching valve 122 for shifting it to the right-hand position shown in FIG. 1. This keeps a condition where the pilot line 51 is not communicated with the reservoir 97, but communicated with the pilot pump 96, and the pilot line 52 is communicated with the reservoir 97.

On the other hand, the potentiometer 5A of the electric lever device 3A outputs an electric signal depending on the input amount of the control lever 4A, the electric signal being input through the A/D converter 6*e* to the metering calculating section 6*a* in the controller 6. The metering calculating section 6*a* calculates a drive signal corresponding to the electric signal and outputs the drive signal which is then input through the D/A converter-amplifier 6*g* to the solenoid proportional valve 91A associated with the directional control valve 8A. In response to the drive signal, the solenoid proportional valve 91A communicates the primary pilot line 51*a* with the secondary pilot line 51*b* in a predetermined opening (see FIG. 2). Since the pilot line 51 is communicated with the pilot pump 96 through the solenoid switching valve 121 so that the primary pilot pressure is supplied to the solenoid proportional valve 91A, as mentioned above, the secondary pilot pressure corresponding to the drive signal is applied from the solenoid proportional valve 91A to the pilot operated section 21A of the directional control valve 8A. On the contrary, the pilot line 52 is communicated with the reservoir 97 through the solenoid switching valve 122, and the primary pilot pressure supplied to the solenoid proportional valve 92A is reduced down to the reservoir pressure. Accordingly, the directional control valve 8A is shifted to the left-hand position shown in FIG. 1 and the hydraulic fluid delivered from the hydraulic pump 95 is supplied to the bottom side of the boom cylinder 7A. As a result, the boom cylinder 7A is operated in a direction to extend depending on the input amount by which the control lever 4A is operated in the direction $x_1$.

Also, when the control lever 4A is operated in the direction $x_2$ as opposed to the above case while the control lever 4B of the electric lever device 3B is in the neutral position, the operation position sensor 30$A_2$ outputs a low-level signal and the operation position sensors 30$A_1$, 30$B_1$, 30$B_2$ output high-level signals, all of these signals being input to the operating direction determinate section *6b*. Therefore, the AND circuit *6b*$_1$ outputs a high-level signal and the AND circuit *6b*$_2$ outputs a low-level signal, whereupon the switch signal is output from the amplifier *6h* to the solenoid switching valve 121 for shifting it to the right-hand position shown in FIG. 1, but the switch signal is not output from the amplifier *6h* to the solenoid switching valve 122 so that the solenoid switching valve 122 is not shifted and remains held in the left-hand position shown in FIG. 1. This keeps a condition where the pilot line 51 is communicated with the reservoir 97 for reducing the primary pilot pressure down to the reservoir pressure, but the pilot line 52 is communicated with the pilot pump 96. On the other hand, the potentiometer 5A outputs an electric signal depending on the input amount of the control lever 4A, and the metering calculating section *6a* calculates a drive signal corresponding to the electric signal, the drive signal being then input to the solenoid proportional valve 92A associated with the directional control valve 8A. The secondary pilot pressure corresponding to the drive signal is thereby applied from the solenoid proportional valve 92A to the pilot operated section 22A. On the contrary, the primary pilot pressure supplied to the solenoid proportional valve 91A is reduced down to the reservoir pressure through the solenoid switching valve 121. Accordingly, the directional control valve 8A is shifted to the right-hand position shown in FIG. 1 and the hydraulic fluid delivered from the hydraulic pump 95 is supplied to the rod side of the boom cylinder 7A. As a result, the boom cylinder 7A is operated in a direction to contract depending on the input amount by which the control lever 4A is operated in the direction $x_2$.

When the control lever 4B is operated in the direction $y_1$ while the control lever 4A is in the neutral position, or when the control lever 4B is operated in the direction $y_2$ while the control lever 4A is in the neutral position, the directional control valve 8B is shifted to the left-hand or right-hand position shown in FIG. 1 following the same control sequence as described above, and the arm cylinder 7B is operated to extend or contract depending on the input amount by which the control lever 4B is operated in the direction $y_1$, $y_2$.

Further, when the control lever 4A is operated in the direction $x_1$ and the control lever 4B is operated in the direction $y_1$ in a combined operation, the AND circuit *6b*$_1$ outputs a low-level signal so that the solenoid switching valve 121 is not shifted and remains held in the left-hand position shown in FIG. 1, and the AND circuit *6b*$_2$ outputs a high-level signal for shifting the solenoid switching valve 122 to the right-hand position shown in FIG. 1. Accordingly, the secondary pilot pressure is supplied to the pilot operated sections 21A, 21B of the directional control valves 8A, 8B, causing the directional control valves 8A, 8B to be both shifted to the left-hand shift positions shown in FIG. 1. As a result, the boom cylinder 7A and the arm cylinder 7B are both operated in respective directions to extend depending on the amounts by which the control levers 4A, 4B are operated in the directions $x_1$, $y_1$. Likewise, when the control lever 4A is operated in the direction $x_2$ and the control lever 4B is operated in the direction $y_2$ in a combined operation, the boom cylinder 7A and the arm cylinder 7B are both operated to contract depending on the amounts by which the control levers 4A, 4B are operated in the directions $x_2$, $y_2$.

Moreover, when the control lever 4A is operated in the direction $x_1$ and the control lever 4B is operated in the direction $y_2$, or when the control lever 4A is operated in the direction $x_2$ and the control lever 4B is operated in the direction $y_1$, both the AND circuits *6b*$_1$, *6b*$_2$ output low-level signals so that both the solenoid switching valves 121, 122 remain held in the left-hand shift positions shown in FIG. 1. Therefore, the directional control valves 8A, 8B are shifted as required depending on the respective input amounts of the control levers 4A, 4B, realizing the desired combined operation of the boom cylinder 7A and the arm cylinder 7B.

Additionally, when the control levers 4A, 4B are both in the neutral positions, all of the operation position sensors 30$A_1$, 30$A_2$, 30$B_1$, 30$B_2$ output high-level signals and both the AND circuits *6b*$_1$, *6b*$_2$ output high-level signals, whereupon the solenoid switching valves 121, 122 are both shifted to the right-hand shift positions shown in FIG. 1 and the pilot lines 51, 52 are both communicated with the reservoir 97. Accordingly, the primary pilot pressures supplied to the solenoid proportional valves 91A, 92A of the directional control valve 8A and the solenoid proportional valves 91B, 92B of the directional control valve 8B are all reduced down to the reservoir pressure. As with the prior art, therefore, even if an error signal is produced in the controller 6, etc. due to a failure or mixing of noise and any of the solenoid proportional valves 91A, 92A, 91B, 92B of the directional control valves 8A, 8B is excited by the error signal to become open, the secondary pilot pressure supplied to any of the pilot operated sections 21A, 22A, 21B, 22B is reduced down to the reservoir pressure through the solenoid switching valve 121, 122 and the directional control valves 8A, 8B are held in the neutral positions, thereby keeping the boom cylinder 7A and the arm cylinder 7B in a stopped condition. It is thus possible to prevent the boom cylinder 7A and the arm cylinder 7B from being moved against the intention of the operator and to ensure safety.

An operating advantage of this embodiment will be described below.

Figure 5:
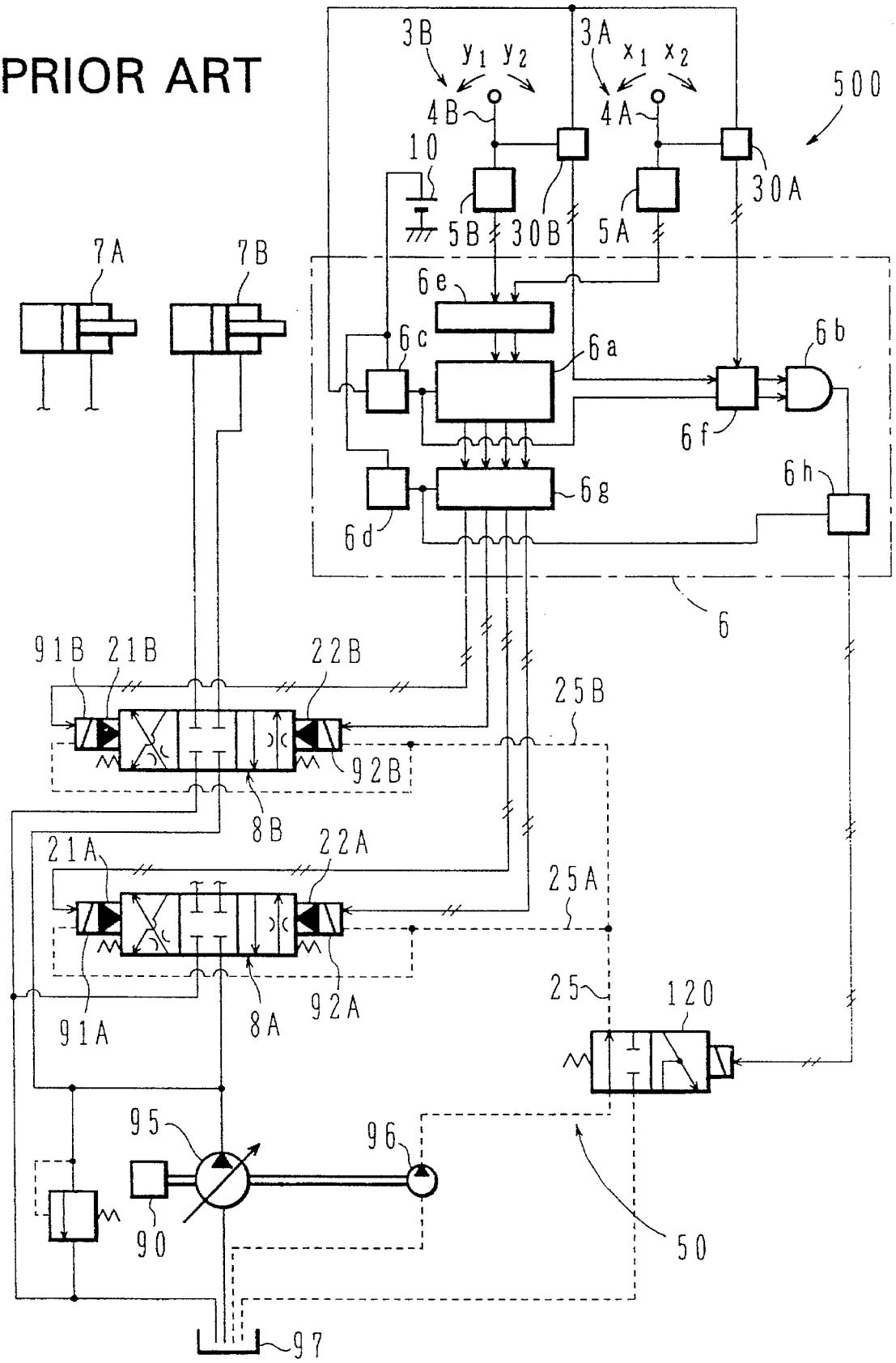
FIG.5 PRIOR ART
FIG. 5 is a circuit diagram showing a drive control system for hydraulic machines in the prior art.

As a comparative example for this embodiment, a circuit diagram showing a drive control system 500 for hydraulic machines in the prior art is illustrated in FIG. 5. Identical members and functions similar to those in the drive control system 100 for hydraulic machines of this embodiment shown in FIG. 1 are denoted by the same reference numerals.

In FIG. 5, the drive control system 500 is different from the drive control system 100 of this embodiment in that neutral position sensors 30A, 30B for detecting the respective neutral positions of the control levers 4A, 4B are provided, instead of the operation position sensors 30$A_1$, 30$A_2$, 30$B_1$, 30$B_2$ for detecting the directions in which the control levers 4A, 4B are operated, to output low-level signals when the control levers 4A, 4B are in the neutral positions and high-level signals when the control levers 4A, 4B are in non-neutral positions, these signals being input to one AND circuit *6b* provided in the controller 6, and that the pilot circuit 50 includes a pilot line 25 comprised of a pilot line 25A for connecting the pilot pump 96 to the solenoid proportional valves 91A, 92A of the directional control valve 8A, and a pilot line 25B for connecting the pilot pump 96 to the solenoid proportional valves 91B, 92B of the directional control valve 8B, with one solenoid switching valve 120 disposed in the pilot line 25 which valve 120 receives a switch signal from the AND circuit *6b* and can selectively communicate and cut off the pilot line 25 with and from the reservoir 97. The remaining arrangement is substantially the same as that in the drive control system 100 of this embodiment.

In the above arrangement, for example, when an operator operates the control lever 4A of the electric lever device 3A from the neutral position in the direction $x_1$ or $x_2$ while the control lever 4B of the electric lever device 3B is in the neutral position, the neutral position sensor 30A outputs a low-level signal and the neutral position sensor 30B outputs a high-level signal, these signals being input to the AND circuit 6*b* through the A/D converter 6*f*. Therefore, the AND circuit 6*b* outputs a low-level signal and the switch signal is not output from the amplifier 6*h* to the solenoid switching valve 120 so that the solenoid switching valve 120 is not shifted and remains held in the left-hand position shown in FIG. 5. This keeps a condition where the pilot line 25 is communicated with the reservoir 97. On the other hand, the potentiometer 5A of the electric lever device 3A outputs an electric signal depending on the input amount of the control lever 4A, and the metering calculating section 6*a* calculates a drive signal corresponding to the electric signal, the drive signal being then input to the solenoid proportional valve 91A or 92A associated with the directional control valve 8A. The primary pilot pressure supplied through the solenoid switching valve 120 is converted by the solenoid proportional valve 91A or 92A into a secondary pilot pressure corresponding to the drive signal, and the secondary pilot pressure is applied to the pilot operated section 21A or 22A. As a result, the directional control valve 8A is shifted to the left-hand or right-hand position shown in FIG. 5 and the boom cylinder 7A is operated in a direction to extend or contract depending on the input amount by which the control lever 4A is operated in the direction $x_1$ or $x_2$.

When the control lever 4B is operated in the direction $y_1$ or $y_2$ while the control lever 4A is in the neutral position, the arm cylinder 7B is operated to extend or contract depending on the input amount by which the control lever 4B is operated in the direction $y_1$ or $y_2$, following the same control sequence as described above.

Also, when the control levers 4A, 4B are both in the non-neutral positions for combined operation, the AND circuit 6*b* outputs a low-level signal and the solenoid switching valve 120 is not shifted and remains held in the left-hand position shown in FIG. 5. Accordingly, the directional control valves 8A, 8B are shifted as required depending on the respective input amounts of the control levers 4A, 4B, realizing the desired combined operation of the boom cylinder 7A and the arm cylinder 7B.

Furthermore, when the control levers 4A, 4B are both in their neutral positions, the neutral position sensors 30A, 30B each output a high-level signal and the AND circuit 6*b* also outputs a high-level signal. Therefore, the solenoid switching valve 120 is shifted to the right-hand position shown in FIG. 5 and the pilot line 25 is communicated with the reservoir 97 so that the primary pilot pressures supplied to the solenoid proportional valves 91A, 92A of the directional control valve 8A and the solenoid proportional valves 91B, 92B of the directional control valve 8B are all reduced down to the reservoir pressure. As a result, even if an error signal is produced in the controller 6, etc. due to a failure or mixing of noise and any of the solenoid proportional valves 91A, 92A, 91B, 92B of the directional control valves 8A, 8B is excited by the error signal to become open, the secondary pilot pressure supplied to any of the pilot operated sections 21A, 22A of the directional control valve 8A and the pilot operated sections 21B, 22B of the directional control valve 8B is reduced down to the reservoir pressure and the directional control valves 8A, 8B are held in the neutral positions, thereby keeping the boom cylinder 7A and the arm cylinder 7B in a stopped condition. It is thus possible to prevent the boom cylinder 7A and the arm cylinder 7B from being moved against the intention of the operator and to ensure safety.

Assuming now, for example, that, of the solenoid proportional valves 91A, 92A at the opposite ends of the directional control valve 8A, the solenoid proportional valve 91A corresponding to the operation of the control lever 4A in the direction $x_1$ is failed to be left open during any of the above-described various operation conditions, the secondary pilot pressure from the solenoid proportional valve 91A continues to be applied to the pilot operated section 21A regardless of the input amount of the control lever 4A. This means that the directional control valve 8A can no longer control the speed and is held in the left-hand position shown in FIG. 5. Accordingly, since the hydraulic fluid from the hydraulic pump 95 continues to be supplied to the bottom side of the boom cylinder 7A, the boom of the hydraulic excavator keeps on extending, resulting in such a danger as that a building or the like locating above the boom may be damaged.

In the above event, the operator usually tends to, by a reflex action, return the control lever 4A in the $x_2$ direction, i.e., make the reversing-lever operation, aiming to avoid the danger. At this time, as described above, the neutral position sensor 30A outputs a low-level signal and the neutral position sensor 30B outputs a high-level signal. Therefore, the AND circuit 6*b* outputs a low-level signal and the switch signal is not output from the amplifier 6*h* to the solenoid switching valve 120 so that the solenoid switching valve 120 remains held in the left-hand position shown in FIG. 1. This keeps a condition where the pilot line 25A is communicated with the pilot pump 96 through the solenoid switching valve 120. Thus, as a result of operating the control lever 4A in the direction $x_2$ as the reversing-lever operation, the secondary pilot pressure is applied to the pilot operated section 22A of the directional control valve 8A through the solenoid proportional valve 92A. But, at the same time, the secondary pilot pressure is also applied to the pilot operated section 21A on the opposite side through the solenoid proportional valve 91A which has been failed to be left open. It is therefore difficult to shift the directional control valve 8A to the left in FIG. 5 for returning it to the neutral position.

In the drive control system 100 of this embodiment, on the contrary, when the operator makes the reversing-lever operation as with the above case, the operation position sensor $30A_2$ outputs a low-level signal and the operation position sensors $30A_1$, $30B_1$, $30B_2$ output high-level signals in FIG. 1. Therefore, the AND circuit $6b_2$ outputs a low-level signal and the AND circuit $6b_1$ outputs a high-level signal, whereupon the switch signal is output from the amplifier 6*h* to the solenoid switching valve 121 for shifting it to the right-hand position shown in FIG. 1, but the switch signal is not output from the amplifier 6*h* to the solenoid switching valve 122 so that the solenoid switching valve 122 remains held in the left-hand position shown in FIG. 1. This keeps a condition where the pilot line 51 is communicated with the reservoir 97, but the pilot line 52 is communicated with the pilot pump 96. At this time, in response to the operation of the control lever 4A in the direction $x_2$ as the reversing-lever operation, the drive signal from the metering calculating section 6*a* is input to the solenoid proportional valve 92A of the directional control valve 8A for excitation of the solenoid proportional valve 92A. The secondary pilot pressure corresponding to the drive signal is thereby applied from the solenoid proportional valve 92A to the pilot operated section 22A of the directional control valve 8A. On the contrary, the primary pilot pressure supplied to the solenoid proportional valve 91A is reduced down to the reservoir pressure through the solenoid switching valve 121. Accordingly, the directional control valve 8A held in the left-hand position shown in FIG. 1 can be easily shifted to the left for return to the neutral position, thereby stopping the operation of the boom cylinder 7A to extend. It is thus possible to prevent unexpected accidents.

Furthermore, in the prior art drive control system 500 shown in FIG. 5, if the control lever 4A is not subject to the reversing-lever operation in the direction $x_2$ and is returned to the neutral position in the above case, the neutral position sensor 30A outputs a high-level signal and the AND circuit 6*b* also outputs a high-level signal. Therefore, the solenoid switching valve 120 is shifted to the right-hand position shown in FIG. 5 and the primary pilot pressures supplied to the solenoid proportional valves 91A, 92A of the directional control valve 8A are all reduced down to the reservoir pressure. As a result, the directional control valve 8A can be returned to the neutral position for stopping the operation of the boom cylinder 7A so that the boom may be held rest at a certain position. After holding the boom rest at the certain position, however, in an attempt to operate the boom from the stopped position oppositely to the original operating direction for return to a predetermined position, as soon as the control lever 4A is operated from the neutral position in the direction $x_2$, the solenoid switching valve 120 is shifted to the left-hand position shown in FIG. 5. Therefore, the primary pilot pressure from the pilot pump 96 is supplied to the pilot line 25A again, causing the secondary pilot pressures to be supplied to both the pilot operated sections 21A, 22A of the directional control valve 8A. This results in a difficulty in operating the boom for return to the predetermined position.

In the drive control system 100 of this embodiment, on the contrary, when the control lever 4A is further operated in the direction $x_2$ after holding the boom rest at the certain position, the switch signal is not output from the amplifier 6*h* to the solenoid switching valve 122, keeping the pilot line 52 communicated with the pilot pump 96, but the switch signal is output from the amplifier 6*h* to the solenoid switching valve 121 so that the pilot line 51 is communicated with the reservoir 97. Thus, the secondary pilot pressure can be supplied to the pilot operated section 22A through the solenoid proportional valve 92A which is not failed, for further operating the boom from the rest position to be returned to the predetermined position. Consequently, the operability of actuators after they have once been stopped can be improved in comparison with the prior art.

Generally, in hydraulic machines such as hydraulic excavators, there may occur a contamination sticking problem resulting from a small metallic piece such as part of a mechanical component making up the hydraulic circuit breaking off and falling into the hydraulic circuit, or from dust in the atmosphere mixing in the hydraulic circuit, and the dust, etc. entering sliding areas of a spool of a directional control valve, causing the spool to seize and fail to operate any more. Upon the occurrence of such a contamination sticking problem, the directional control valve is jammed to be left open and a hydraulic actuator associated with the directional control valve can no longer be controlled, leading to a fear of giving rise to an unexpected accident.

In the event of the occurrence of such a contamination sticking problem, it is conventionally customary for the operator to make the above-mentioned reversing-lever operation. The reversing-lever operation upon the occurrence of such a problem will be described with reference to FIG. 6 which is a circuit diagram showing a basic prior art actuator system of hydraulic pilot type.

Figure 6:
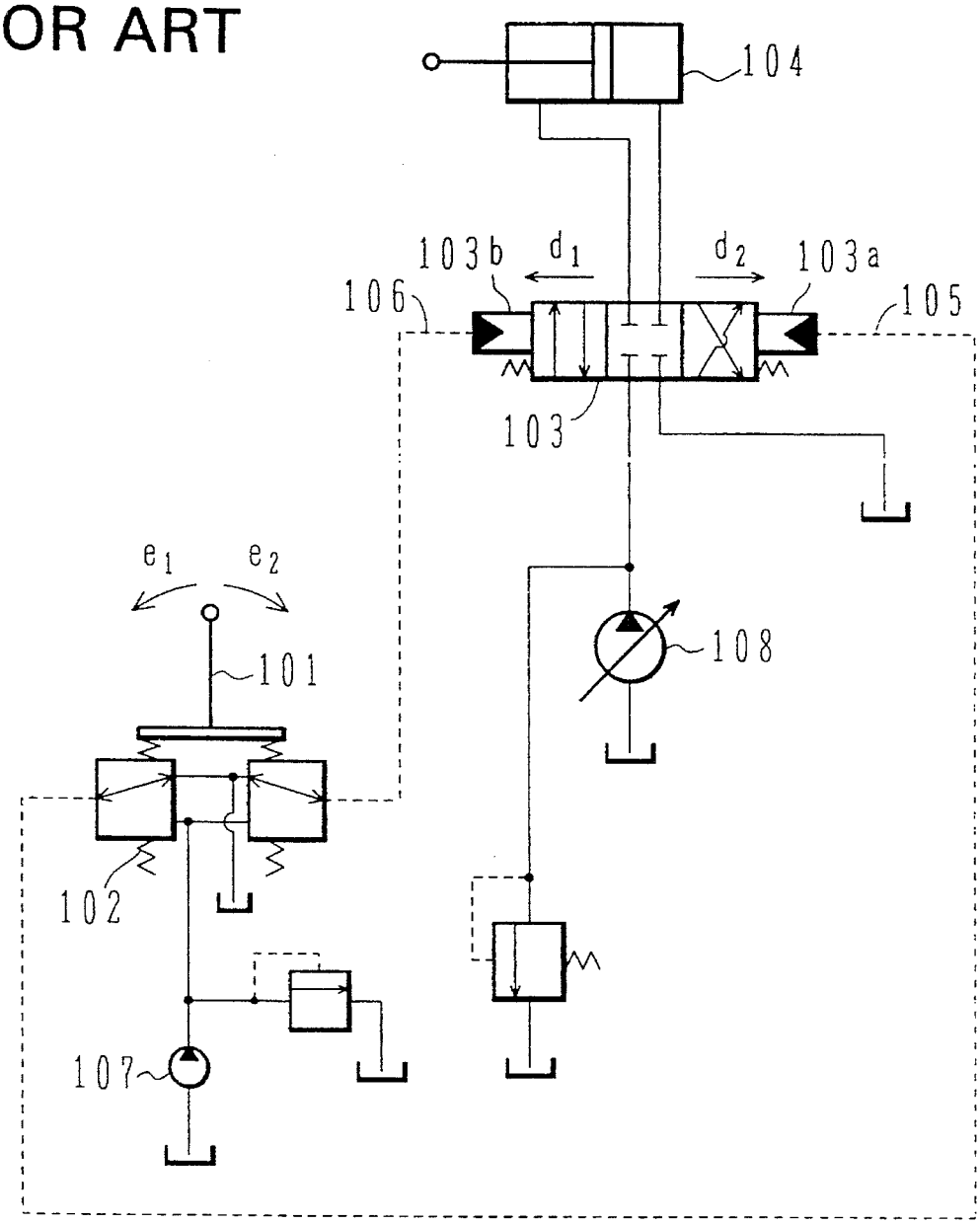
FIG.6 PRIOR ART
FIG. 6 is a circuit diagram showing a basic prior art actuator system of hydraulic pilot type.

The actuator system of hydraulic pilot type shown in FIG. 6 comprises a control lever 101 operable in any of a direction $e_1$ and a direction $e_2$ with its neutral position therebetween, a hydraulic pump 107 for generating a hydraulic pressure, a hydraulic pump 108 driven by a prime mover, a pilot-operated directional control valve 103 for controlling a flow of a hydraulic fluid supplied from the hydraulic pump 108 to a hydraulic cylinder 104, a pilot line 105 for supplying the pilot pressure to a pilot operated section 103*a* of the directional control valve 103, a pilot line 106 for supplying the pilot pressure to a pilot operated section 103*b* of the directional control valve 103, and a pressure reducing valve 102 for reducing the pilot pressure from the pilot pump 107 depending on the operation of the control lever 101 and supplying the reduced pressure to each of the pilot lines 105, 106.

In the above arrangement, assume that there occurs the above-described contamination sticking problem, for example, under a condition where the operator operates the control lever 101 in the direction $e_1$ so that the pilot pressure is applied to the pilot operated section 103*a* through the pilot line 105 and the spool of the directional control valve 103 is moved in a direction $d_1$, i.e., under a condition where the directional control valve 103 is shifted to its right-hand position shown in FIG. 6. In a usual case, if the operator returns the control lever 101 to the neutral position from a position in the direction $e_1$, the directional control valve 103 is returned to the neutral position by the restoring force of a spring associated with the directional control valve 103. Upon the occurrence of the contamination, however, the spool is seized and the directional control valve 103 cannot return to the neutral position. Accordingly, the hydraulic fluid from the hydraulic pump 108 continues to be supplied to the bottom side of the hydraulic cylinder 104 of which operation to extend is not stopped. This may result in a fear of causing a severe accident depending on the situation.

In the above case, therefore, the operator immediately makes the reversing-lever operation by turning the control lever 101 from the original operation area (direction $e_1$) into the opposite operation area (direction $e_2$) beyond the neutral position. By this operation, the hydraulic fluid delivered from the pilot pump 107 is reduced in pressure by the pressure reducing valve 102 and then supplied to the pilot operated section 103*b* of the directional control valve 103 through the pilot line 106 so that a force stronger than the restoring force of the spring is applied to the spool. Therefore, the spool of the directional control valve 103 becomes free from seizure and is pushed back to move in the direction $d_2$ oppositely to the original direction $d_1$. When the directional control valve 103 is returned to the neutral position, the operator returns the control lever 101 to the neutral position. This prevents the hydraulic fluid from being supplied to the hydraulic cylinder 104, enabling the hydraulic cylinder 104 to be stopped. Thus, it is usual to operate the control lever in such a manner as to make the reversing-lever operation upon the occurrence of a contamination sticking problem.

Assume now that, in the prior art drive control system 500 shown in FIG. 5, the directional control valve 8A is subject to a contamination sticking problem in addition to the above-described failure of the solenoid proportional valve 91A. In other words, it is supposed that the spool of the directional control valve 8A is subject to a contamination sticking problem under a condition where the operator operates the control ever 4A in the direction $x_1$ and the directional control valve 8A is shifted to the left-hand position. In this case, even when the operator operates the control lever 4A in the direction $x_2$ for making the reversing-lever operation to overcome the contamination problem stick as with the above case, the AND circuit 6*b* outputs a low-level signal and the switch signal is not output to the solenoid switching valve 120, keeping the pilot line 25A communicated with the pilot pump 96 through the solenoid switching valve 120. Thus, the secondary pilot pressure is supplied to not only the pilot operated section 22A, but also the pilot operated section 21A on the opposite side through the solenoid proportional valve 91A which has been failed to be left open. This results in a difficulty in overcoming the contamination sticking by applying a force directing leftward in FIG. 5 to the directional control valve 8A.

In the drive control system 100 of this embodiment, on the contrary, with the reversing-lever operation effected by the operator by operating the control lever 4A in the direction $x_2$, the secondary pilot pressure can be supplied to the pilot operated section 22A through the solenoid proportional valve 92A not failed, whereas the primary pilot pressure to the solenoid proportional valve 91A failed and hence the secondary pilot pressure to the pilot operated section 21A can be reduced down to the reservoir pressure, as described above. It is therefore possible to apply a force directing leftward in FIG. 5 to the directional control valve 8A for shifting the same and to overcome the contamination sticking. By returning the control lever 4A to the neutral position in the above condition, the directional control valve 8A can be returned to the neutral position so as to stop the boom cylinder 7A.

With this embodiment, as described above, even if the solenoid proportional valve 91A is failed to be left open when the operator is operating the control lever 4A in the direction $x_1$ to operate the boom cylinder 7A in the direction to extend, and the operator makes the reversing-lever operation by operating the control lever 4A in the direction $x_2$ with intent to avoid a danger, the predetermined secondary pilot pressure is supplied to the pilot operated section 22A on the side corresponding to the direction $x_2$, whereas the secondary pilot pressure supplied to the pilot operated section 21A on the side corresponding to the direction $x_1$ is reduced. Therefore, the operator can shift the directional control valve 8A for surely returning the same to the neutral position, and can stop the boom cylinder 7A from operating in the direction to extend, whereby the boom can be held rest so as to avoid a danger. Consequently, it is possible to prevent an unexpected accident.

Also, after the directional control valve 8A has been returned to the neutral position to hold the boom rest at a certain position, it is often desired to further move the boom from the rest position in the direction as opposed to the original direction for return to a predetermined position. In this case, by operating the control lever 4A in the direction $x_2$ to shift the directional control valve 8A in the opposite direction, the primary pilot pressure and the secondary pilot pressure can be supplied to the solenoid proportional valve 92A not failed and the pilot operated section 22A, whereas the primary pilot pressure and the secondary pilot pressure to the solenoid proportional valve 91A failed and the pilot operated section 21A can be reduced down to the reservoir pressure. Therefore, the directional control valve 8A can be shifted in the opposite direction so that the boom is moved from the rest position and returned to the predetermined position. It is thus possible to improve operability of the boom after once stopped in comparison with the prior art.

Further, in the event the directional control valve 8A is subject to a contamination stick problem in addition to a failure of the solenoid proportional valve 91A, with the reversing-lever operation effected by the operator by operating the control lever 4A in the direction $x_2$, the primary pilot pressure and the secondary pilot pressure can be supplied to the solenoid proportional valve 92A not failed and the pilot operated section 22A, whereas the primary pilot pressure and the secondary pilot pressure to the solenoid proportional valve 91A failed and the pilot operated section 21A can be reduced down to the reservoir pressure. Therefore, the contamination sticking can be overcome by applying a force in the opposite direction to the directional control valve 8A.

Moreover, a similar advantage as described above can also be obtained in a like manner when the solenoid proportional valve 92A of the directional control valve 8A corresponding to the operation of the control lever 4A in the direction $x_2$ is failed, when any of the solenoid proportional valves 91B, 92B of the directional control valve 8B corresponding respectively to the operation of the control lever 4B in the directions $y_1$, $y_2$ is failed, and when the directional control valve 8A or 8B is subject to a contamination sticking problem in addition to a failure of any of those solenoid proportional valves.

While the actuators 7A, 7B are described in the above embodiment respectively as a boom cylinder and an arm cylinder of a hydraulic excavator, the present invention is not limited to the above embodiment. For example, the actuator may be any of a bucket cylinder, a left-hand travel motor, a right-hand travel motor, a swing motor and so on. Also, the operation of the actuator is not limited to the extension or contraction, but may be effected in the form of advancement and retreatment of the travel motor, or clockwise and counterclockwise movement of the swing motor.

While the above embodiment includes the two electric lever devices 3A, 3B, the two actuators (boom cylinder and arm cylinder) 7A, 7B, the two directional control valves 8A, 8B, and the two sets of operation position sensors 30$A_1$, 30$A_2$; 30$B_1$, 30$B_2$, the present invention is not limited to such an arrangement, and those components may be provided three or more or three or more sets. In this case, the solenoid proportional valves 91A, 91B, . . . and the pilot operated sections 21A, 21B, . . . on one side of the directional control valves 8A, 8B, . . . are all connected to the pilot line 51, and the solenoid proportional valves 92A, 92B, . . . and the pilot operated sections 22A, 22B, . . . on the other side are all connected to the pilot line 52. Also, the operation signals or the non-operation signals from the operation position sensors 30$A_1$, $B_1$, . . . associated with the control levers 4A, B . . . in the directions $x_1$, $y_1$, . . . are input to the AND circuit 6*b*$_1$ of the operating direction determinate section 6*b* in the controller 6, and the operation signals or the non-operation signals from the operation position sensors 30$A_2$, $B_2$, . . . associated with the control levers 4A, B . . . in the directions $x_2$, $y_2$, . . . are input to the AND circuit 6*b*$_2$. Then, only when all of the control levers 4A, 4B . . . are in the neutral positions or are operated in the directions $x_2$, $y_2$, . . . , the solenoid switching valve 121 is shifted to the right-hand position shown in FIG. 1 and the primary pilot pressure in the pilot line 51 is reduced down to the reservoir pressure. In other condition, i.e., when at least one of the control levers is operated in one of the directions $x_1$, $y_1$, . . . , the solenoid switching valve 121 is held in the left-hand position shown in FIG. 1 so as to maintain the primary pilot pressure in the pilot line 51. Likewise, only when all of the control levers 4A, 4B . . . are in their neutral positions or are operated in the directions $x_1$, $y_1$, . . . , the solenoid switching valve 122 is shifted to the right-hand position shown in FIG. 1 and the primary pilot pressure in the pilot line 52 is reduced down to the reservoir pressure. In other condition, i.e., when at least one of the control levers is operated in one of the directions $x_2$, $y_2$, . . . , the solenoid switching valve 122 is held in the left-hand position shown in FIG. 1 so as to maintain the primary pilot pressure in the pilot line 52.

Second Embodiment

A second embodiment of the present invention will be described with reference to FIGS. 7 to 10. This embodiment is concerned with a drive control system for hydraulic machines which includes operation position detecting means different from those in the first embodiment.

Figure 7:
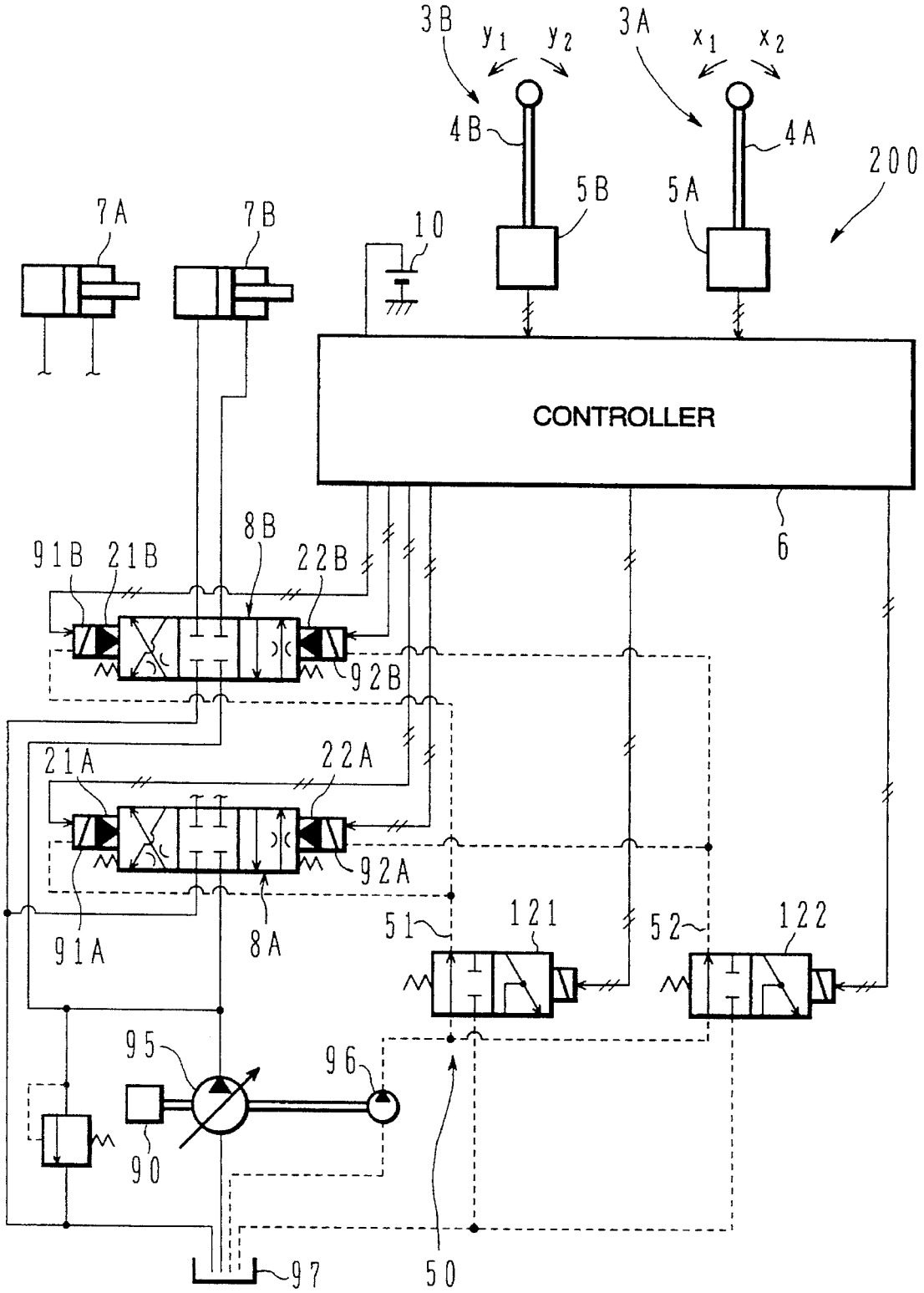
FIG. 7 is a circuit diagram showing a drive control system for hydraulic machines according to a second embodiment of the present invention.
Figure 8:
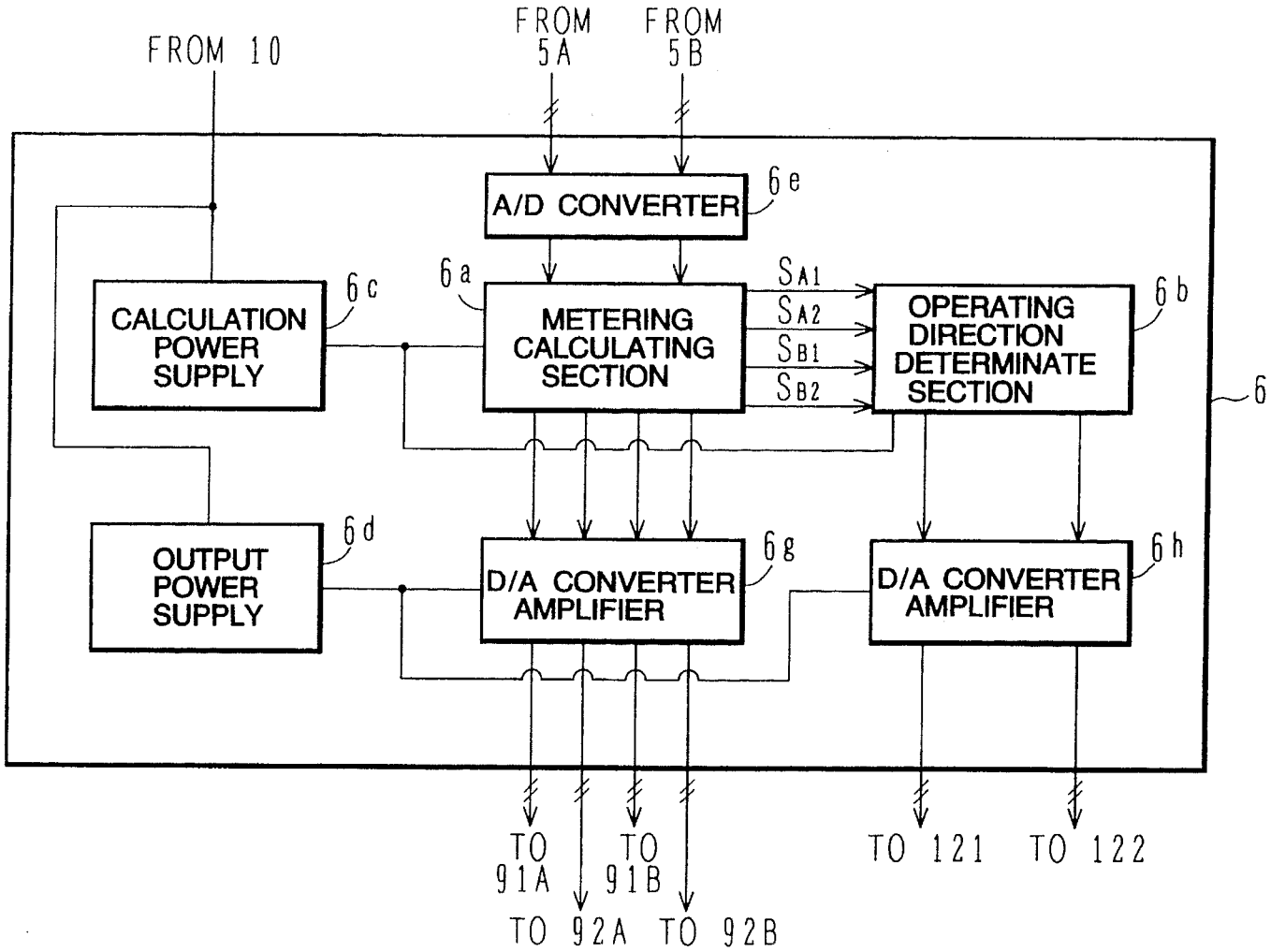
FIG. 8 is a block diagram showing details of functions of a controller shown in FIG. 7.

A circuit diagram showing a drive control system 200 for hydraulic machines of this embodiment is illustrated in FIG. 7, and details of functions of a controller 6 is shown in FIG. 8. Identical functions to those in the drive control system 100 of the first embodiment are denoted by the same reference numerals.

In FIGS. 7 and 8, the drive control system 200 of this embodiment is different from the drive control system 100 of the first embodiment in that the operation position sensors 30$A_1$, 30$A_2$, 30$B_1$, 30$B_2$ and the A/D converter 6*f* in the controller 6 are omitted, and the metering calculating section 6*a* creates signals indicating in which directions the control levers 4A, 4B are operated, based on the magnitudes of the electric signals from the potentiometers 5A, 5B, the created signals being input to the operating direction determinate section 6*b* which outputs switch signals for shifting the solenoid switching valves 121, 122. The remaining functions are substantially the same as those in the above first embodiment.

Figure 9:
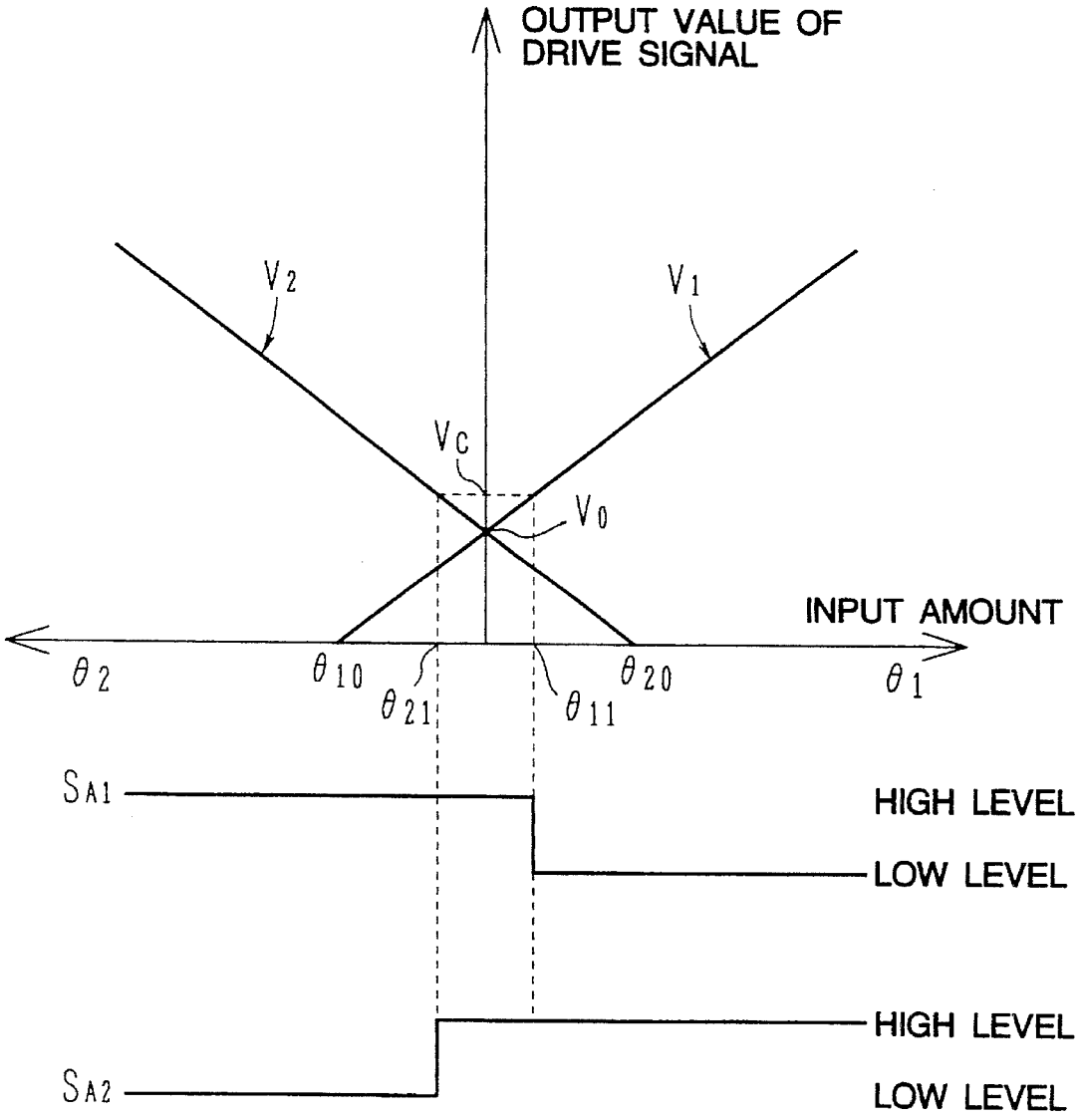
FIG. 9 is a diagram showing the relationship between an input amount of a control lever and output values of drive signals issued to the solenoid proportional valves, and the relationship between the magnitudes of the output values and signals indicating in which direction the control lever is operated, these relationships being set in a metering calculating section.

Details of functions of the metering calculating section 6*a* in the drive control system 200 of this embodiment will be described with reference to FIG. 9. FIG. 9 shows the relationship between an input amount of the control lever 4A and output values of the drive signals issued to the solenoid proportional valves 91A, 92A, and the relationship between the magnitudes of the output values and signals indicating in which direction the control lever 4A is operated, these relationships being set in the metering calculating section 6*a*.

In FIG. 9, the horizontal axis represents the input amount of the control lever 4A such that the input amount by which the control lever 4A is operated in the direction $x_1$ is indicated by $\theta_1$, and the input amount by which it is operated in the direction $x_2$ is indicated by $\theta_2$. The vertical axis represents the magnitudes of output values of the drive signals issued from the metering calculating section 6*a* to the solenoid proportional valves 91A, 92A of the directional control valve 8A through the D/A converter-amplifier 6*g*. As shown, the metering calculating section 6*a* sets therein, as characteristic lines for setting metering characteristics of the input amount versus the drive signals, an output value $V_1$ which increases with an increase in the input amount of the control lever 4A in the direction $x_1$ and an output value $V_2$ which is increased with an increase in the input amount of the control lever 4A in the direction $x_2$. The output value $V_1$ is zero when the control lever 4*a* is operated by $\theta_{10}$ in the direction $x_2$, is increased with a reduction in $\theta_2$ to take a certain value $V_0$ when the input amount is zero, i.e., at the neutral point, and is further increased proportionally to an increase in the input amount $\theta_1$ in the direction $x_1$. The output value $V_2$ is zero when the control lever 4*a* is operated by $\theta_{20}$ in the direction $x_1$, is increased proportionally to a reduction in $\theta_1$ to take a certain value $V_0$ when the input amount is zero, i.e., at the neutral point, and is further increased proportionally to an increase in the input amount $\theta_2$ in the direction $x_2$. Also, to determine whether the control lever 4A is in the neutral position or not from the two output values $V_1$, $V_2$, a set value $V_C$ that is slightly larger than the values $V_0$ of $V_1$, $V_2$ at the neutral point is defined in view of a dead zone. Specifically, the set value $V_C$ is defined such that $V_1 = V_C$ holds when the input amount $\theta_1$ of the control lever 4A in the direction $x_1$ is $\theta_{11}$ and $V_2 = V_C$ holds when the input amount $\theta_2$ of the control lever 4A in the direction $x_2$ is $\theta_{21}$.

Further, the metering calculating section 6*a* includes calculating means for detecting the operating direction of the control lever 4A based on the magnitudes of the output values $V_1$, $V_2$ and creating signals $S_{A1}$, $S_{A2}$ indicating in which direction the control lever 4A is operated. In the calculating means, the relationships between these two signals $S_{A1}$, $S_{A2}$ and the output values $V_1$, $V_2$ are set as shown in FIG. 9. More specifically, the signal $S_{A1}$ is a signal that is created corresponding to the output value $V_1$ and indicates whether or not the control lever 4A is operated in the direction $x_1$. The signal $S_{A1}$ is provided as a high-level signal indicating a non-operated condition in the case of $V_1 \leqq V_C$, i.e., when the control lever 4A is operated in the direction $x_2$ or the input amount $\theta_1$ in the direction $x_1$ is smaller than $\theta_{11}$, and a low-level signal indicating an operated condition in the case of $V_1 > V_C$, i.e., when the input amount $\theta_1$ of the control lever 4A in the direction $x_1$ is greater than $\theta_{11}$. The signal $S_{A2}$ is a signal that is created corresponding to the output value $V_2$ and indicates whether or not the control lever 4A is operated in the direction $x_2$. The signal $S_{A2}$ is provided as a high-level signal indicating a non-operated condition in the case of $V_2 \leqq V_C$, i.e., when the control lever 4A is operated in the direction $x_1$ or the input amount $\theta_2$ in the direction $x_2$ is smaller than $\theta_{21}$, and a low-level signal indicating an operated condition in the case of $V_2 > V_C$, i.e., when the input amount $\theta_2$ of the control lever 4A in the direction $x_2$ is greater than $\theta_{21}$. By so setting, when the input amount of the control lever 4A is not only zero, but also small (i.e., $\theta_1 < \theta_{11}$, $\theta_2 < \theta_{21}$), the control lever 4A is regarded to be in the neutral position and the signals $S_{A1}$, $S_{A2}$ are both created as high-level signals.

The foregoing concerns with the functions of the metering calculating section 6*a* relating to the control lever 4A. Though not particularly shown, the metering calculating section 6*a* also sets therein characteristic lines for setting metering characteristics of the input amounts in the directions $y_1$, $y_2$ versus output values of the drive signals output to the solenoid proportional valves 91B, 92B, these characteristic lines being similar to those shown in FIG. 9, but related to the control lever 4B. Further, based on the magnitudes of output values of the drive signals, the calculating means creates signals $S_{B1}$, $S_{B2}$ indicating in which direction the control lever 4B is operated. Then, the four signals $S_{A1}$, $S_{A2}$, $S_{B1}$, $S_{B2}$ are input to the operating direction determinate section 6*b*.

Figure 10:
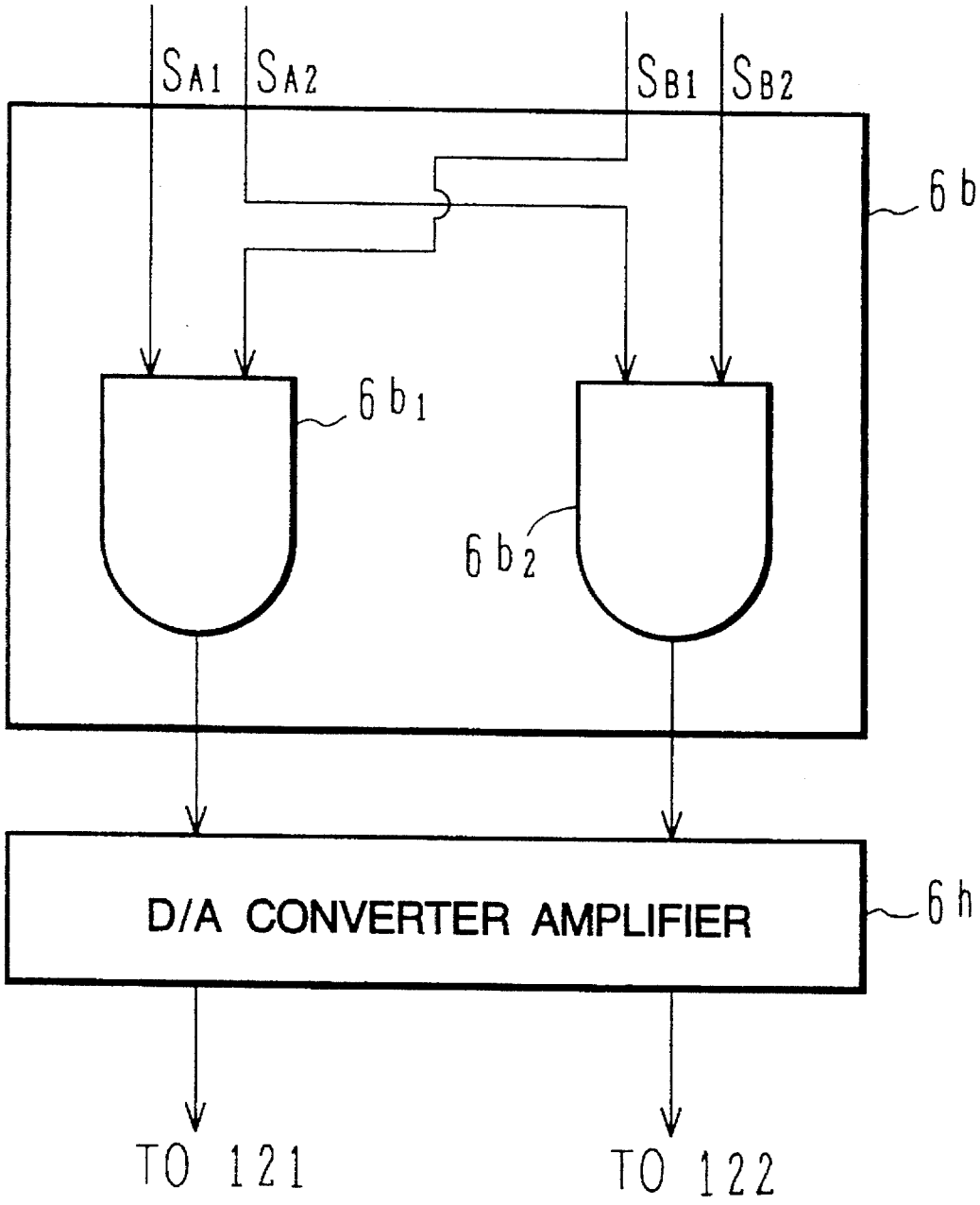
FIG. 10 is a block diagram showing details of functions of an operating direction determinate section shown in FIG. 8.

Details of functions of the operating direction determinate section 6*b* is shown in FIG. 10. Referring to FIG. 10, the operating direction determinate section 6*b* of this embodiment is arranged basically similarly to the operating direction determinate section 6*b* of the first embodiment except that the four signals $S_{A1}$, $S_{A2}$, $S_{B1}$, $S_{B2}$ are input to the section 6*b* from the metering calculating section 6*a*, as described above.

In the above arrangement of the drive control system 200 of this embodiment, the potentiometers 5A, 5B and the metering calculating section 6*a* cooperatively make up the operation position detecting means for detecting in which ones of the directions $x_1$, $y_1$ or the directions $x_2$, $y_2$ the control levers 4A, 4B are operated.

This embodiment thus constructed operates as follows.

For example, when the operator operates the control lever 4A of the electric lever device 3A from the neutral position in the direction $x_1$ (on condition of $\theta_1 > \theta_{11}$) while the control lever 4B of the electric lever device 3B is in the neutral position, the signal $S_{A1}$ takes a low level and the signal $S_{A2}$ takes a high level (see FIG. 9), whereas both the signals $S_{B1}$, $S_{B2}$ take a high level because they are set as with the signals $S_{A1}$, $S_{A2}$ shown in FIG. 9. Accordingly, the signal $S_{A1}$ of a low level and the signal $S_{B1}$ of a high level are input to the AND circuit $6b_1$ of the operating direction determinate section 6b, causing the AND circuit $6b_1$ to output a low-level signal. On the other hand, the signal $S_{A1}$ of a high level and the signal $S_{B1}$ of a high level are input to the AND circuit $6b_2$ thereof, causing the AND circuit $6b_2$ to output a high-level signal. The subsequent operation is similar to that in the first embodiment.

Also, when the control lever 4A is operated from the neutral position in the direction $x_2$ as opposed to the above case (on condition of $\theta_2 > \theta_{21}$) while the control lever 4B of the electric lever device 3B is in the neutral position, the signal $S_{A2}$ takes a low level and the signals $S_{A1}$, $S_{B1}$, $S_{B2}$ take a high level. Accordingly, the AND circuit $6b_1$ outputs a high-level signal and the AND circuit $6b_2$ outputs a low-level signal. The subsequent operation is similar to that in the first embodiment.

Further, when the control lever 4B is operated in the direction $y_1$ or $y_2$ while the control lever 4A is in the neutral position, or when the control lever 4A is operated in the direction $x_1$ or $x_2$ and the control lever 4B is operated in the direction $y_1$ or $y_2$ in a combined operation, the AND circuits $6b_1$, $6b_2$ also output similar signals to those in the first embodiment with the above-described arrangement. Thus, the subsequent operation is also similar to that in the first embodiment.

Consequently, this embodiment can provide a similar advantage to that in the first embodiment with no need of the operation position sensors.

While the above-described embodiment includes the two electric lever devices 3A, 3B, the two actuators (boom cylinder and arm cylinder) 7A, 7B, and the two directional control valves 8A, 8B, the present invention is not limited to such an arrangement, and those components may be provided three or more. In this case, the solenoid proportional valves 91A, 91B, . . . and the pilot operated sections 21A, 21B, . . . on one side of the directional control valves 8A, 8B, . . . are all connected to the pilot line 51, and the solenoid proportional valves 92A, 92B, . . . and the pilot operated sections 22A, 22B, . . . on the other side are all connected to the pilot line 52. Also, the metering calculating section 6a in the controller 6 sets therein characteristic lines indicating metering characteristics of the input amounts of the control levers 4A, 4B, . . . versus output values of the drive signals output to the solenoid proportional valves 91A, 92A; 91B, 92B; . . . . Based on the magnitudes of output values of these drive signals, the calculating means in the metering calculating section 6a creates the signals $S_{A1}$; $S_{A2}$, $S_{B1}$; $S_{B2}$ . . . indicating in which directions the control levers 4A, 4B . . . are operated. Then, the signals $S_{A1}$, $S_{B1}$, . . . indicating that the control levers 4A, 4B . . . are operated in the directions $x_1$, $y_1$, . . . , respectively, are input to the AND circuit $6b_1$ of the operating direction determinate section 6b, and the signals $S_{A2}$, $S_{B2}$, . . . indicating that the control levers 4A, 4B . . . are operated in the directions $x_2$, $y_2$, . . . , respectively, are input to the AND circuit $6b_2$ thereof. Then, only when all of the control levers 4A, 4B . . . are in the neutral positions or are operated in the directions $x_2$, $y_2$, . . . , the solenoid switching valve 121 is shifted to the right-hand position shown in FIG. 1 and the primary pilot pressure in the pilot line 51 is reduced down to the reservoir pressure. In other condition, i.e., when at least one of the control levers is operated in one of the directions $x_1$, $y_1$, . . . , the solenoid switching valve 121 is held in the left-hand position shown in FIG. 1 so as to maintain the primary pilot pressure in the pilot line 51. Likewise, only when all of the control levers 4A, 4B . . . are in the neutral positions or are operated in the directions $x_1$, $y_1$, . . . , the solenoid switching valve 122 is shifted to the right-hand position shown in FIG. 1 and the primary pilot pressure in the pilot line 52 is reduced down to the reservoir pressure. In other condition, i.e., when at least one of the control levers is operated in one of the directions $x_2$, $y_2$, . . . , the solenoid switching valve 122 is held in the left-hand position shown in FIG. 1 so as to maintain the primary pilot pressure in the pilot line 52.

INDUSTRIAL APPLICABILITY

According to the present invention, even if the electro-hydraulic conversion means is failed to be left open when an operator is operating a control lever in the first operation area to operate an actuator in one direction, and the operator makes the reversing-lever operation by operating the control lever into the second operation area with intent to avoid a danger, a predetermined secondary pilot pressure is supplied to a pilot operated section on the side corresponding to the second operation area, whereas the secondary pilot pressure supplied to a pilot operated section on the side corresponding to the first operation area is reduced. Therefore, the operator can shift a directional control valve in a direction corresponding to the second operation area for surely returning to the neutral position, and can stop the actuator from operating in that one direction, whereby a working machine can be held at rest so as to avoid a danger. Consequently, it is possible to prevent an unexpected accident.

Also, after the directional control valve has been returned to the neutral position to hold the working machine at rest at a certain position, it is often desired to further move the working machine from the rest position in the other direction for return to a predetermined position. In this case, by operating the control lever into the second operation area to shift the directional control valve in the opposite direction beyond the neutral position, the primary pilot pressure and the secondary pilot pressure can be supplied to the electro-hydraulic conversion means, which is not failed and corresponds to the second operation area, and the associated pilot operated section, whereas the primary pilot pressure and the secondary pilot pressure to the electro-hydraulic conversion means failed and the associated pilot operated section can be reduced. Therefore, the working machine can be further moved from the rest position in the other direction and returned to the predetermined position. It is thus possible to improve operability of the working machine after once stopped in comparison with the prior art.

Further, in the event the directional control valve is subject to a contamination sticking problem in addition to a failure of the above electro-hydraulic conversion means corresponding to the first operation area, with the reversing-lever operation effected by the operator, the primary pilot pressure and the secondary pilot pressure can be supplied to the electro-hydraulic conversion means not failed and the associated pilot operated section, whereas the primary pilot pressure and the secondary pilot pressure to the electro-hydraulic conversion means failed and the associated pilot operated section can be reduced. Therefore, the contamination sticking can be overcome by shifting the directional control valve in the opposite direction.

Additionally, a similar advantage as described above can also be obtained in a like manner when the electro-hydraulic conversion means corresponding to the second operation area is failed as opposed to the above case, or when the directional control valve is subject to a contamination stick in addition to a failure of the electro-hydraulic conversion means.

We claim:

1. A drive control system for hydraulic machines comprising an electric lever device (3A, 3B) which includes a control lever (4A, 4B) operable in each of first and second operation areas ($x_1$, $y_1$; $x_2$, $y_2$) with its neutral position therebetween and output means (5A, 5B) for generating an electric signal depending on an input amount of said control lever (4A, 4B), first calculating means (6*a*) for calculating a drive signal corresponding to said electric signal, a pilot circuit (50) including a hydraulic source (96) for generating a primary pilot pressure, and a pilot-operated directional control valve (8A, 8B) provided respectively at opposite ends with electro-hydraulic conversion means (91A, 92A; 91B, 92B) each of which receives the drive signal from said first calculating means (6*a*) and the primary pilot pressure from said pilot circuit (50) and outputs a secondary pilot pressure corresponding to said drive signal, and with pilot operated sections (21A, 22A; 21B, 22B) to which the secondary pilot pressures are applied from said electro-hydraulic conversion means (91A, 92A; 91B, 92B), said directional control valve (8A, 8B) being driven with the secondary pilot pressures applied to said pilot operated sections (21A, 22A; 21B, 22B) for controlling a hydraulic fluid supplied to a hydraulic actuator (7A, 7B), wherein:

said drive control system further comprises operation position detecting means (30$A_1$, 30$A_2$, 30$B_1$, 30$B_2$; 5A, 5B, 6*a*) for detecting in which one of said first and second operation areas ($x_1$, $y_1$; $x_2$, $y_2$) said control lever (4A, 4B) is operated, and pilot pressure control means (121, 122, 51, 52, 6*b*) disposed in said pilot circuit (50) for reducing the primary pilot pressure applied to said electro-hydraulic conversion means (91A, 91B) on the side corresponding to said first operation area ($x_1$, $y_1$) when said operation position detecting means (30$A_1$, 30$B_1$; 5A, 5B, 6*a*) does not detect that said control lever (4A, 4B) is operated into said first operation area ($x_1$, $y_1$), holding the primary pilot pressure applied to said electro-hydraulic conversion means (91A, 91B) on the side corresponding to said first operation area ($x_1$, $y_1$) when said operation position detecting means (30$A_1$, 30$B_1$; 5A, 5B, 6*a*) detects that said control lever (4A, 4B) is operated into said first operation area ($x_1$, $y_1$), reducing the primary pilot pressure applied to said electro-hydraulic conversion means (92A, 92B) on the side corresponding to said second operation area ($x_2$, $y_2$) when said operation position detecting means (30$A_2$, 30$B_2$; 5A, 5B, 6*a*) does not detect that said control lever (4A, 4B) is operated into said second operation area ($x_2$, $y_2$), and holding the primary pilot pressure applied to said electro-hydraulic conversion means (92A, 92B) on the side corresponding to said second operation area ($x_2$, $y_2$) when said operation position detecting means (30$A_2$, 30$B_2$, 5A, 5B, 6*a*) detects that said control lever (4A, 4B) is operated into said second operation area ($x_2$, $y_2$).

2. A drive control system for hydraulic machines according to claim 1, wherein said pilot circuit (50) comprises a first pilot line (51) for connecting said hydraulic source (96) to said electro-hydraulic conversion means (91A, 91B) on the side corresponding to said first operation area ($x_1$, $y_1$), and a second pilot line (52) being independent of said first pilot circuit (51) and connecting said hydraulic source (96) to said electro-hydraulic conversion means (92A, 92B) on the side corresponding to said second operation area ($x_2$, $y_2$), and said pilot pressure control means (121, 122, 51, 52, 6*b*) comprises a first solenoid switching valve (121) disposed in said first pilot line (51) for communicating said first pilot line (51) with a reservoir (97) when said operation position detecting means (30$A_1$, 30$B_1$; 5A, 5B, 6*a*) does not detect that said control lever (4A, 4B) is operated into said first operation area ($x_1$, $y_1$), and cutting off communication between said first pilot line (51) and said reservoir (97) when said operation position detecting means (30$A_1$, 30$B_1$; 5A, 5B, 6*a*) detects that said control lever (4A, 4B) is operated into said first operation area ($x_1$, $y_1$), and a second solenoid switching valve (122) disposed in said second pilot line (52) for communicating said second pilot line (52) with said reservoir (97) when said operation position detecting means (30$A_2$, 30$B_2$; 5A, 5B, 6*a*) does not detect that said control lever (4A, 4B) is operated into said second operation area ($x_2$, $y_2$), and cutting off communication between said second pilot line (52) and said reservoir (97) when said operation position detecting means (30$A_2$, 30$B_2$; 5A, 5B, 6*a*) detects that said control lever (4A, 4B) is operated into said second operation area ($x_2$, $y_2$).

3. A drive control system for hydraulic machines according to claim 1, wherein said operation position detecting means comprises first sensor means (30$A_1$, 30$B_1$) disposed in said electric lever device (3A, 3B) for outputting a first non-operation signal when said control lever (4A, 4B) is not operated into said first operation area ($x_1$, $y_1$), and a first operation signal when said control lever (4A, 4B) is operated into said first operation area ($x_1$, $y_1$), and second sensor means (30$A_2$, 30$B_2$) disposed in said electric lever device (3A, 3B) for outputting a second non-operation signal when said control lever (4A, 4B) is not operated into said second operation area ($x_2$, $y_2$), and a second operation signal when said control lever (4A, 4B) is operated into said second operation area ($x_2$, $y_2$).

4. A drive control system for hydraulic machines according to claim 1, wherein said operation position detecting means (5A, 5B, 6*a*) includes second calculating means (6*a*) for creating, based on the magnitude of the electric signal from said electric lever device (3A, 3B), a first non-operation signal when said control lever (4A, 4B) is not operated into said first operation area ($x_1$, $y_1$) and a first operation signal when said control lever (4A, 4B) is operated into said first operation area ($x_1$, $y_1$), and a second non-operation signal when said control lever (4A, 4B) is not operated into said second operation area ($x_2$, $y_2$) and a second operation signal when said control lever (4A, 4B) is operated into said second operation area ($x_2$, $y_2$).

5. A drive control system for hydraulic machines according to claim 1, wherein said electric lever device (3A, 3B), said actuator (7A, 7B), said directional control valve (8A, 8B), and said operation position detecting means (30$A_1$, 30$A_2$, 30$B_1$, 30$B_2$; 5A, 5B, 6*a*) are each provided plural in number, and said pilot pressure control means (121, 122, 51, 52, 6*b*) reduces the primary pilot pressure applied to said electro-hydraulic conversion means (91A, 91B) on the side corresponding to said first operation areas ($x_1$, $y_1$) when all of said plurality of operation position detecting means ($30A_1$, $30B_1$; 5A, 5B, 6*a*) do not detect that said control levers (4A, 4B) are operated into said first operation areas ($x_1$, $y_1$), holds the primary pilot pressure applied to said electro-hydraulic conversion means (91A, 91B) on the side corresponding to said first operation areas ($x_1$, $y_1$) when at least one of said plurality of operation position detecting means ($30A_1$, $30B_1$; 5A, 5B, 6*a*) detect that any of said control levers (4A, 4B) are operated into said first operation areas ($x_1$, $y_1$), reduces the primary pilot pressure applied to said electro-hydraulic conversion means (92A, 92B) on the side corresponding to said second operation areas ($x_2$, $y_2$) when all of said plurality of operation position detecting means ($30A_2$, $30B_2$; 5A, 5B, 6*a*) do not detect that said control levers (4A, 4B) are operated into said second operation areas ($x_2$, $y_2$), and holds the primary pilot pressure applied to said electro-hydraulic conversion means (92A, 92B) on the side corresponding to said second operation areas ($x_2$, $y_2$) when at least one of said plurality of operation position detecting means ($30A_2$, $30B_2$, 5A, 5B, 6*a*) detect that any of said control levers (4A, 4B) are operated into said second operation areas ($x_2$, $y_2$).

6. A drive control system for hydraulic machines according to claim 5, wherein said pilot circuit (50) comprises a first pilot line (51) for connecting said electro-hydraulic conversion means (91A, 91B) on the side corresponding to said first operation areas ($x_1$, $y_1$) of said plurality of directional control valves (8A, 8B) to said hydraulic source (96), and a second pilot line (52) being independent of said first pilot circuit (51) and connecting said electro-hydraulic conversion means (92A, 92B) on the side corresponding to said second operation areas ($x_2$, $y_2$) of said plurality of directional control valves (8A, 8B) to said hydraulic source (96), and said pilot pressure control means (121, 122, 51, 52, 6*b*) comprises a first solenoid switching valve (121) disposed in said first pilot line (51) for communicating said first pilot line (51) with a reservoir (97) when all of said plurality of operation position detecting means ($30A_1$, $30B_1$; 5A, 5B, 6*a*) do not detect that said control levers (4A, 4B) are operated into said first operation areas ($x_1$, $y_1$), and cutting off communication between said first pilot line (51) and said reservoir (97) when at least one of said plurality of operation position detecting means ($30A_1$, $30B_1$; 5A, 5B, 6*a*) detects that any of said control levers (4A, 4B) is operated into said first operation area ($x_1$, $y_1$), and a second solenoid switching valve (122) disposed in said second pilot line (52) for communicating said second pilot line (52) with said reservoir (97) when all of said plurality of operation position detecting means ($30A_2$, $30B_2$; 5A, 5B, 6*a*) do not detect that said control levers (4A, 4B) are operated into said second operation areas ($x_2$, $y_2$), and cutting off communication between said second pilot line (52) and said reservoir (97) when at least one of said operation position detecting means ($30A_2$, $30B_2$; 5A, 5B, 6*a*) detects that any of said control lever (4A, 4B) is operated into said second operation area ($x_2$, $y_2$).

7. A drive control system for hydraulic machines according to claim 1, wherein said electro-hydraulic conversion means include solenoid proportional valves (91A, 92A; 91B. 92B) of which openings are controlled in accordance with the drive signals from said first calculating means (6*a*).

* * * * *